US009436125B2

(12) United States Patent
Fukushima et al.

(10) Patent No.: US 9,436,125 B2
(45) Date of Patent: Sep. 6, 2016

(54) POWDER CONTAINER AND IMAGE FORMING APPARATUS INCORPORATING SAME

(71) Applicants: Tatsuo Fukushima, Osaka (JP); Masanari Fujita, Osaka (JP)

(72) Inventors: Tatsuo Fukushima, Osaka (JP); Masanari Fujita, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/715,818

(22) Filed: May 19, 2015

(65) Prior Publication Data

US 2015/0346636 A1 Dec. 3, 2015

(30) Foreign Application Priority Data

May 27, 2014 (JP) ..... 2014-109177

(51) Int. Cl.
*G03G 15/08* (2006.01)
*G03G 21/16* (2006.01)

(52) U.S. Cl.
CPC ..... *G03G 15/0886* (2013.01); *G03G 21/1633* (2013.01); *G03G 2215/0132* (2013.01); *G03G 2215/0827* (2013.01)

(58) Field of Classification Search
CPC ..... G03G 15/0886; G03G 21/1633; G03G 2215/0132; G03G 2215/0827
USPC ..... 399/260
See application file for complete search history.

(56) References Cited

U.S. PATENT DOCUMENTS

| | | | |
|---|---|---|---|
| 2008/0226358 | A1 | 9/2008 | Hanashima et al. |
| 2011/0052261 | A1 | 3/2011 | Fukushima et al. |
| 2012/0114373 | A1 | 5/2012 | Hamada et al. |
| 2013/0028638 | A1 | 1/2013 | Tsuritani et al. |
| 2014/0029962 | A1 | 1/2014 | Shimizu et al. |
| 2014/0050507 | A1 | 2/2014 | Hamada et al. |
| 2014/0161491 | A1 | 6/2014 | Fukushima |
| 2014/0294449 | A1 | 10/2014 | Kubota et al. |

FOREIGN PATENT DOCUMENTS

| | | |
|---|---|---|
| JP | 2014-044323 | 3/2014 |

*Primary Examiner* — David Bolduc
*Assistant Examiner* — Barnabas Fekete
(74) *Attorney, Agent, or Firm* — Oblon, McClelland, Maier & Neustadt, L.L.P.

(57) ABSTRACT

A powder container, storing powder used for an image forming apparatus, includes a container body, an opening, and a shutter. The opening discharges or introduces the powder, and the shutter opens and closes the opening. The shutter includes a first engaging portion and a second engaging portion. The first engaging portion engages a shutter switch, provided to an apparatus body of the image forming apparatus, in a first trajectory. The second engaging portion engages the shutter switch in a second trajectory different from the first trajectory. The shutter approaches and contacts the shutter switch in the first trajectory or the second trajectory to open and close the opening.

19 Claims, 35 Drawing Sheets

POWDER CONTAINER AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2014-109177, filed on May 27, 2014, in the Japan Patent Office, the entire disclosure of which is hereby incorporated by reference herein.

BACKGROUND

1. Technical Field

Exemplary aspects of the present invention relate to a powder container that stores powder used for image formation, and an image forming apparatus including the powder container.

2. Related Art

Image forming apparatuses such as copiers, printers, facsimile machines, or multifunction peripherals having two or more copying, printing, and facsimile functions include detachable toner cartridges.

For example, a related-art image forming apparatus as illustrated in FIG. 43 includes a plurality of toner cartridges 300Y, 300M, 300C, and 300Bk (also referred to collectively as toner cartridges 300) detachably disposed in a rotatable cartridge holder 1020. In FIG. 43, when a cover 1010 of the image forming apparatus is opened, each of the toner cartridges 300 can be removed upward from the cartridge holder 1020. Moreover, as illustrated in FIG. 44, when the cartridge holder 1020 is rotated upward with the toner cartridges 300 attached, the cartridge holder 1020 together with the toner cartridges 300 can be retracted from a position above process units 1110, 1110M, 1110C, and 1110Bk (also collectively referred to as process units 1110). Such a configuration enables the process units 1110 to be attached and detached without having to remove the respective toner cartridges 300.

Moreover, as illustrated in FIG. 45, each of the toner cartridges 300 includes a shutter 600 and each of the process units 1110 includes a shutter switch 1100 in an upper portion thereof to open the shutter 600. The shutter switch 1100 protrudes upward through an insertion hole 1180 formed on the bottom of the cartridge holder 1020. In FIG. 45, the toner cartridge 300 is representative of the toner cartridges 300Y, 300M, 300C, and 300Bk, and the process unit 1110 is representative of the process units 1110Y, 1110M, 1110C, and 1110Bk.

In this case, when the toner cartridge 300 is attached to the cartridge holder 1020 held horizontally, an engaging portion 600*a* of the shutter 600 engages the shutter switch 1100. Such engagement pushes up the engaging portion 600*a* as illustrated with a broken line in FIG. 45, thereby rotating and opening the shutter 600. Moreover, the cartridge holder 1020 may be rotated downward from the orientation illustrated in FIG. 44 with the cartridges 300 attached to the cartridge holder 1020. In such a case, the shutter switch 1100 passes through the insertion hole 1180 to engage the engaging portion 600*a*, so that the shutter 600 is opened. Accordingly, such a structure enables the engaging portion 600*a* to engage the outer shutter switch 1100 such that the shutter 600 is opened regardless of when the toner cartridge 300 is attached or the cartridge holder 1020 is rotated downward.

SUMMARY

In at least one embodiment of this disclosure, there is provided an improved powder container that stores powder used for an image forming apparatus, and includes a container body, an opening, and a shutter. The powder is discharged or introduced through the opening in the container body, and the shutter opens and closes the opening. The shutter includes a first engaging portion and a second engaging portion. The first engaging portion engages a shutter switch, provided to an apparatus body of the image forming apparatus, in a first trajectory. The second engaging portion engages the shutter switch in a second trajectory different from the first trajectory. The shutter approaches and contacts the shutter switch in the first trajectory or the second trajectory to open and close the opening.

In at least one embodiment of this disclosure, there is provided an improved image forming apparatus that includes a powder container, an apparatus body, and a shutter switch. The powder container stores powder used for image formation, and includes a container body, an opening, and a shutter. The powder is discharged or introduced through the opening in the container body, and the shutter opens and closes the opening. The shutter switch, provided to the apparatus body, contacts the shutter to open the shutter that includes a first engaging portion and a second engaging portion. The first engaging portion engages the shutter switch in a first trajectory, whereas the second engaging portion engages the shutter switch in a second trajectory different from the first trajectory. The shutter approaches and contacts the shutter switch in the first trajectory or the second trajectory to open and close the opening.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
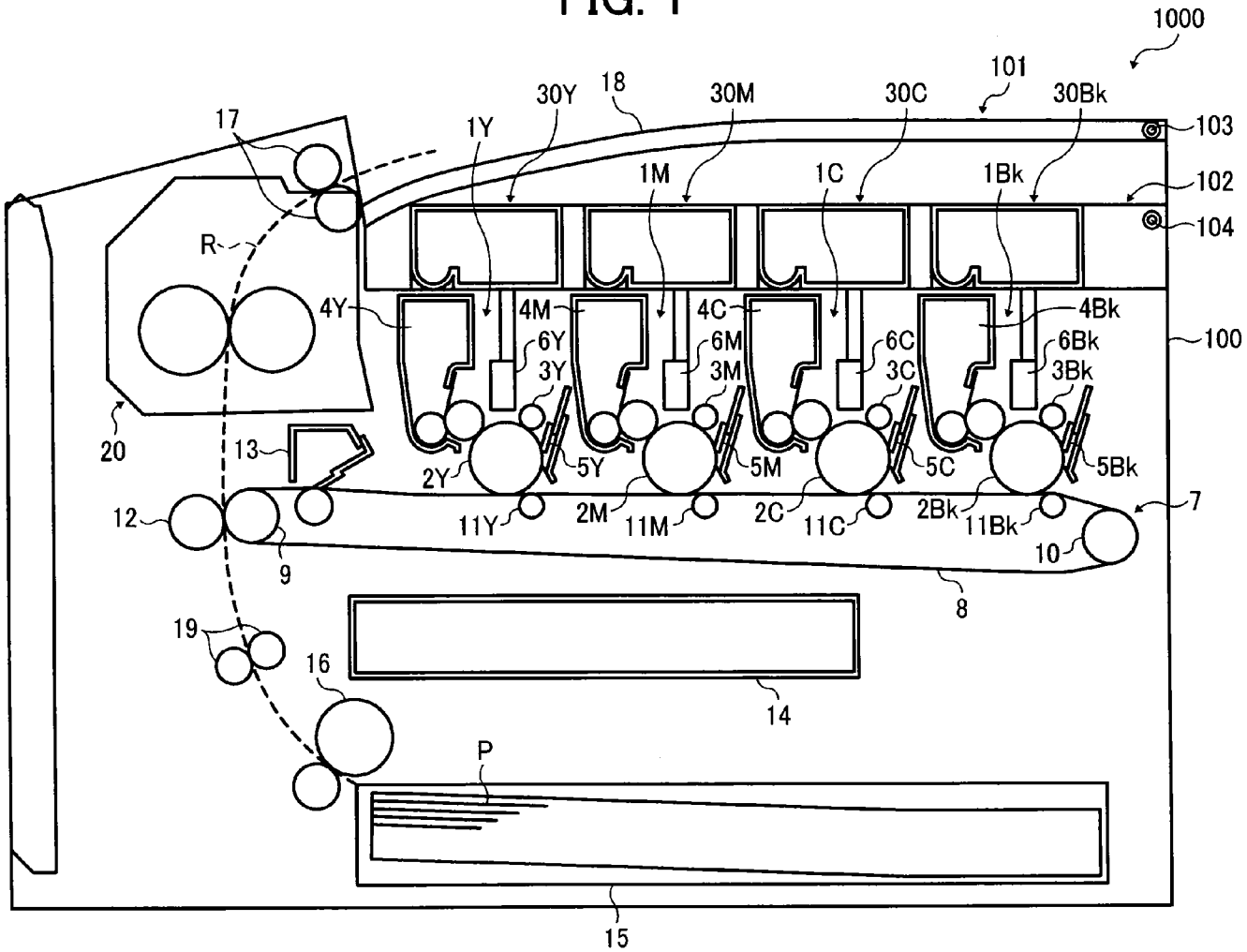
FIG. 1 is a schematic view of an image forming apparatus according to an exemplary embodiment of the present invention.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF THE INVENTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, exemplary embodiments of the present disclosure are described below. In the drawings for explaining the following exemplary embodiments, the same reference codes are allocated to elements (members or components) having the same function or shape and redundant descriptions thereof are omitted below.

Figure 43:
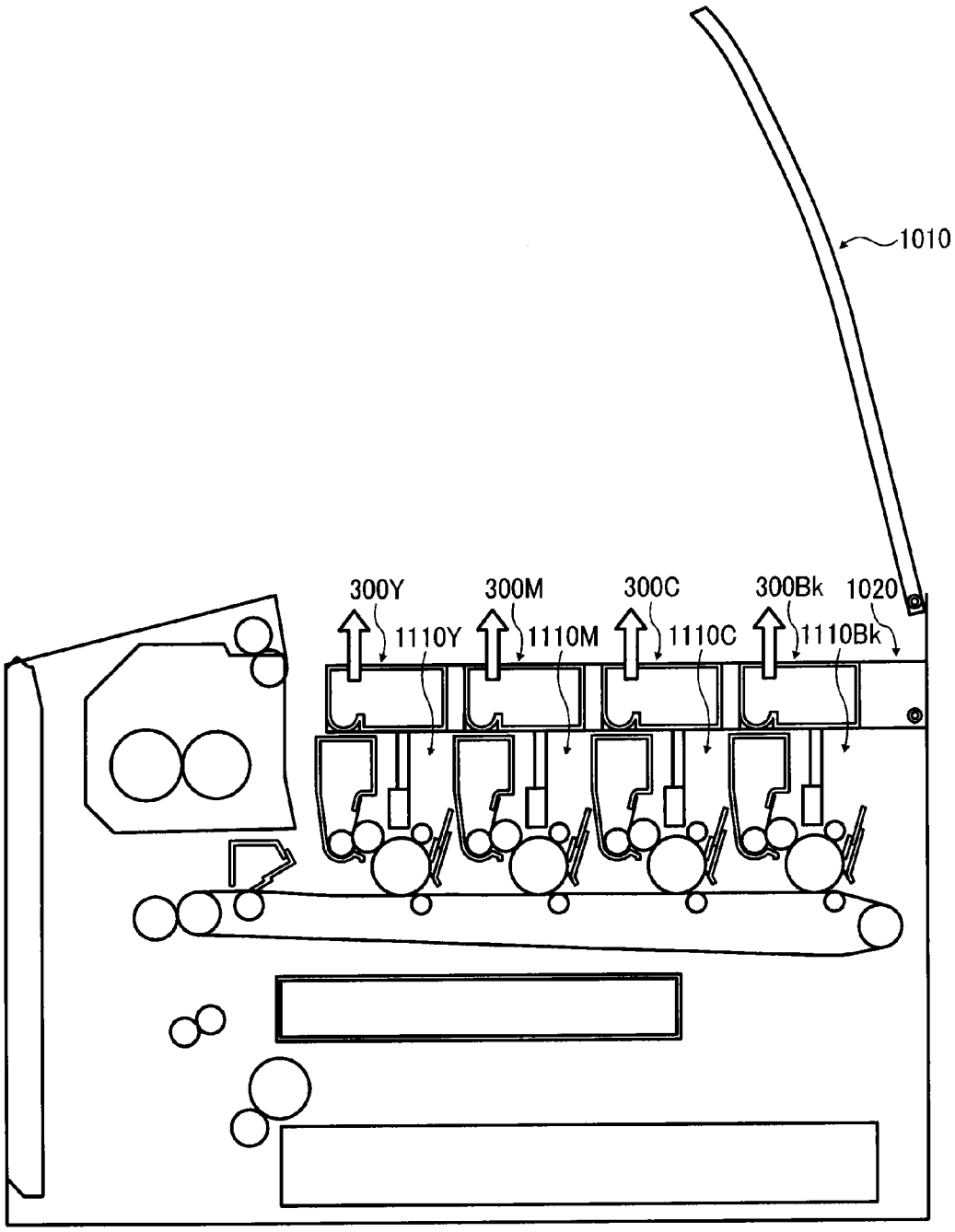
FIG. 43 PRIOR ART
FIG. 43 is a diagram of a related-art image forming apparatus when an upper cover is rotated upward and opened.
Figure 44:
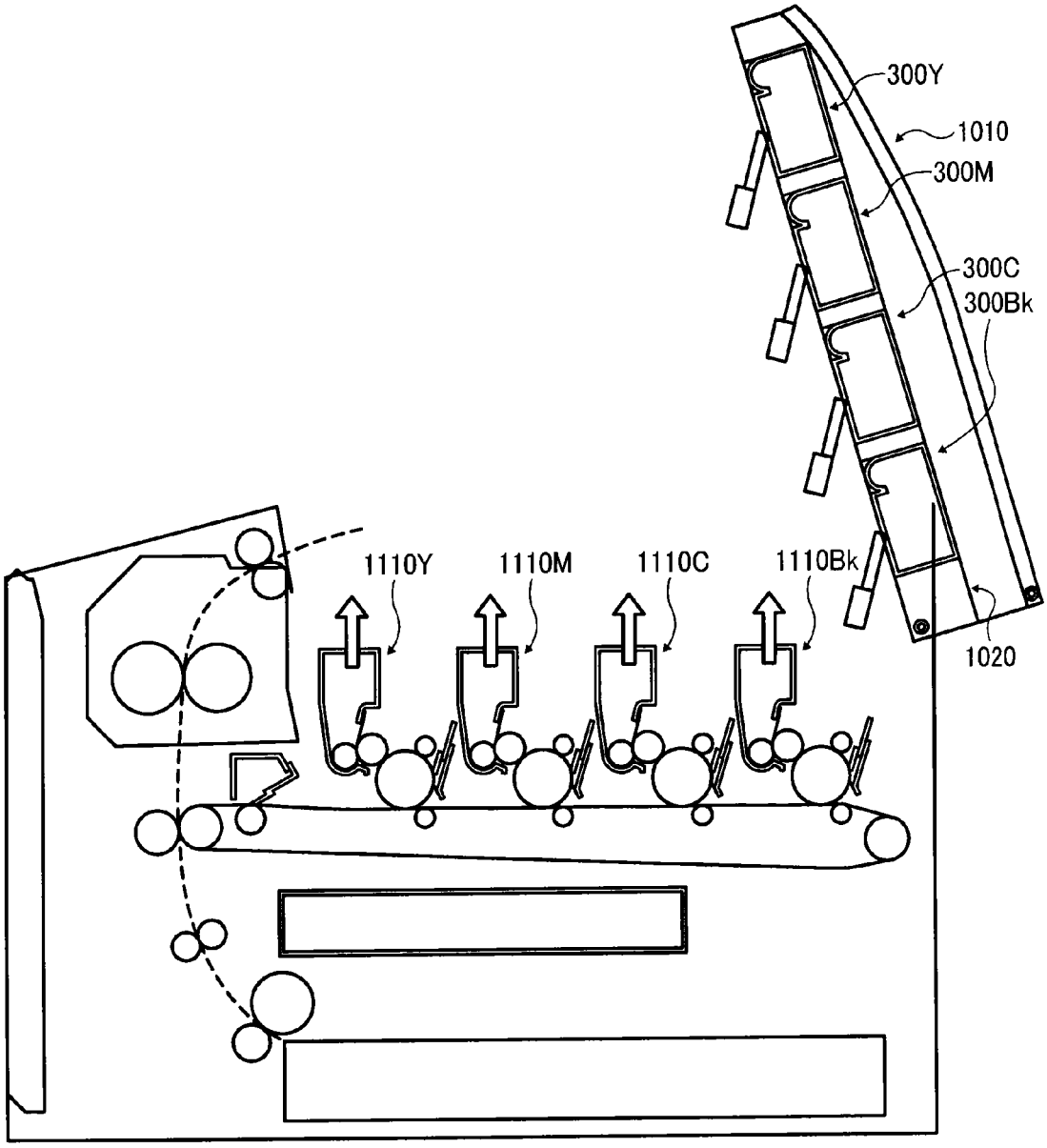
FIG. 44 PRIOR ART
FIG. 44 is a diagram of the related-art image forming apparatus when the upper cover and a cartridge holder are rotated upward.
Figure 45:
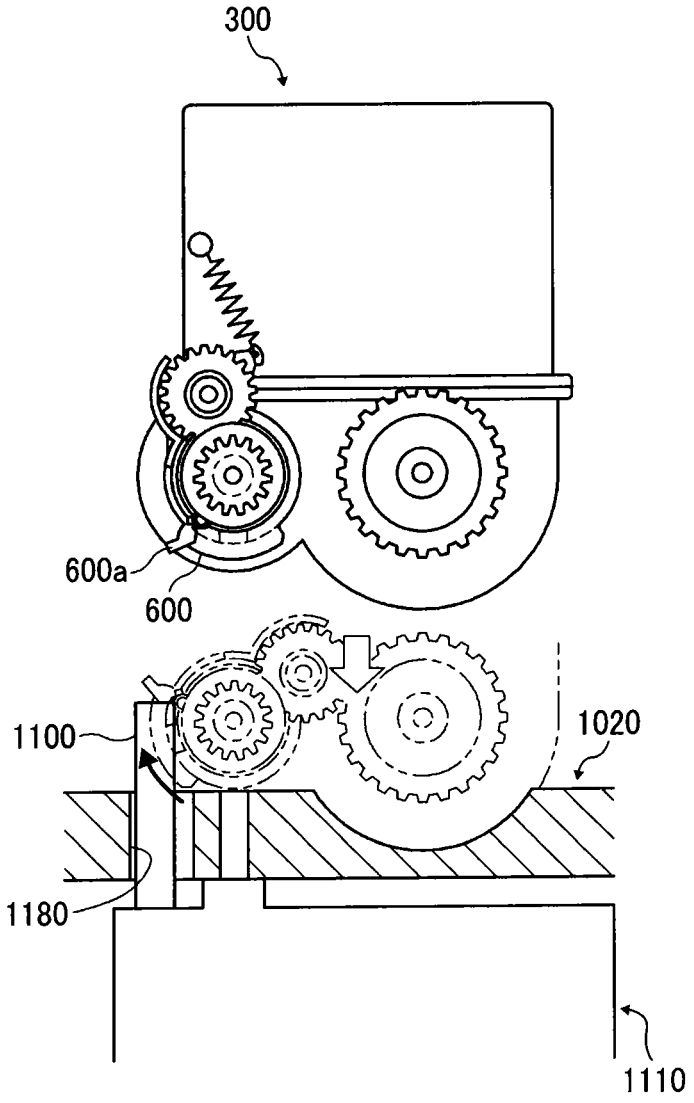
FIG. 45 PRIOR ART
FIG. 45 is a diagram of an operation performed when a toner cartridge is attached to the cartridge holder in the related-art image forming apparatus.

In the related-art image forming apparatus illustrated in FIGS. 43 through 45, a trajectory of the toner cartridge 300 approaching the shutter switch 1100 varies depending on the operation whether attachment of the toner cartridge 300 is performed or rotation of the cartridge holder 1020 is performed. Consequently, a trajectory of the engaging portion 600*a* approaching the shutter switch 1100 varies. In particular, when attachment of the toner cartridge 300 is performed, the toner cartridge 300 is inserted downward substantially perpendicular to the cartridge holder 1020. Thus, a movement trajectory of the engaging portion 600*a* is a vertical direction. On the other hand, when rotation of the cartridge holder 1020 is performed, a trajectory of the engagement portion 600*a* is provided in an arc shape around a rotation axis of the cartridge holder 1020.

In the configuration by which the movement trajectory of the engaging portion 600*a* varies depending on the operation, an engagement location of the engaging portion 600*a* with respect to the shutter switch 1100 varies on a trajectory basis. This causes difficulty in reliably engaging the engaging portion 600*a* within a predetermined area, in comparison with the case of one trajectory. The smaller the apparatus, the smaller the allowable engagement area. When an allowable engagement area of the engaging portion 600*a* becomes smaller, the reliable engagement becomes even more difficult in both of the linear and arc trajectories. Consequently, in a case where the engaging portion 600*a* cannot be engaged within the predetermined area, the shutter 600 is not opened. This may stop the supply of toner from the toner cartridge 300 to a developing device.

Hence, according to an exemplary embodiment of the present invention, a powder container and an image forming apparatus enable an engaging portion that at least first engages a shutter switch to vary depending on a trajectory, so that an engagement state suitable for each trajectory can be obtained.

FIG. 1 illustrates an overall configuration and operations of a color laser printer serving as an image forming apparatus according to one exemplary embodiment of the present invention. However, the exemplary embodiment of the present invention is not limited to the color laser printer. The exemplary embodiment of the present invention may be applied to an image forming apparatus such as a monochrome copier, other printers, a copier, a facsimile machine, and a multifunctional peripheral having at least two of these functions.

As illustrated in FIG. 1, a color laser printer 1000 serving as an image forming apparatus includes an apparatus body 100. The apparatus body 100 includes four process units 1Y, 1M, 1C, and 1Bk detachable from the apparatus body 100. The process units 1Y, 1M, 1C, and 1Bk respectively store toners of yellow (Y), magenta (M), cyan (C), and black (Bk) of color separation components for a color image. Since each of the process units 1Y, 1M, 1C, and 1Bk is substantially similar to every other except for the color of toner, a process unit 1 is described as a representative of all the process units 1Y, 1M, 1C, and 1Bk. In FIG. 1, although components of the process unit 1 are indicated by reference numerals with color abbreviations Y, M, C and Bk, the color abbreviations are omitted in the description below unless otherwise needed.

In particular, the process unit 1 includes a drum-shaped photoconductor 2 serving as a latent image bearer (an image bearer), a charging roller 3 serving as a charging unit for charging a surface of the photoconductor 2, a developing device 4 serving as a developing unit for developing the latent image on the photoconductor 2 into a visible image, and a cleaning blade 5 serving as a cleaning unit for cleaning the surface of the photoconductor 2. Moreover, the process unit 1 includes an exposure device 6 serving as a latent image forming unit for forming a latent image on the surface of the photoconductor 2. The exposure device 6 is disposed in a position opposite the photoconductor 2. In the present exemplary embodiment, a light emitting diode (LED) unit is used as the exposure device 6.

The apparatus body 100 includes toner cartridges 30Y, 30M, 30C, and 30Bk serving as powder containers in which powder toner for image formation is stored. Since each of the toner cartridges 30Y, 30M, 30C, and 30Bk is substantially similar to every other except for the color of toner therein, a toner cartridge 30 is hereinafter described as a representative of all the toner cartridges 30Y, 30M, 30C, and 30Bk. The toner cartridge 30 is disposed above the developing device 4 and detachable from the apparatus body 100. The toner cartridge 30 stores toner the color of which is same as that inside the corresponding developing device 4. When an amount of the toner inside the developing device 4 becomes less than a predetermined amount, toner is supplied from the toner cartridge 30. In the present exemplary embodiment, one-component developer containing toner as image forming powder is used. Alternatively, two-component developer containing toner and carrier may be applied to the present exemplary embodiment of the present invention.

A transfer device 7 is disposed below the photoconductors 2Y, 2M, 2C, and 2Bk. The transfer device 7 includes an intermediate transfer belt 8 including an endless belt serving as an intermediate transfer member (an image bearer). The intermediate transfer belt 8 extends across a drive roller 9 and a driven roller 10 serving as supporting member. In FIG. 1, the intermediate transfer belt 8 moves clockwise with clockwise rotation of the drive roller 9.

Primary transfer rollers 11Y, 11M, 11C, and 11Bk serving as primary transfer units are disposed in positions opposite the photoconductors 2Y, 2M, 2C, and 2Bk, respectively. Since each of the primary transfer rollers 11Y, 11M, 11C, and 11Bk is substantially similar to every other except for the color of toner, a primary transfer roller 11 is hereinafter described as a representative of all the primary transfer rollers 11Y, 11M, 11C, and 11Bk. The primary transfer roller 11 presses an inner circumferential surface of the intermediate transfer belt 8, and the pressed portion of the intermediate transfer belt 8 and the corresponding photoconductor 2 contact each other to form a primary transfer nip. The primary transfer roller 11 is connected to a power source such that a predetermined direct current (DC) voltage and/or an alternative current (AC) voltage are applied to the primary transfer roller 11.

Moreover, a secondary transfer roller 12 serving as a secondary transfer unit is disposed in a position opposite the drive roller 9. The secondary transfer roller 12 presses an outer circumferential surface of the intermediate transfer belt 8, and the pressed portion of the intermediate transfer belt 8 and the secondary transfer roller 12 contact each other to form a secondary transfer nip. As similar to the primary transfer roller 11, the secondary transfer roller 12 is connected to a power source such that a predetermined DC voltage and/or an AC voltage are applied to the secondary transfer roller 12.

Moreover, on the far-left side of the intermediate transfer belt 8 illustrated in FIG. 1, a belt cleaning device 13 is disposed on an outer circumferential surface of the intermediate transfer belt 8. The belt cleaning device 13 cleans a surface of the intermediate transfer belt 8. A waste toner conveyance hose extending from the belt cleaning device 13 is connected to an inlet of a waste toner container 14 disposed below the transfer device 7.

In a lower portion of the apparatus body 100, a sheet feed tray 15 and a feed roller 16 are disposed. The sheet feed tray 15 stores sheets P each serving as a recording medium, and the feed roller 16 feeds a sheet P from the sheet feed tray 15. The term "sheet P" used herein includes thick paper, a post card, an envelope, plain paper, thin paper, coated paper (e.g., art paper), and tracing paper. In addition, an overhead projector (OHP) sheet and an OHP film can be used as a recording medium.

In an upper portion of the apparatus body 100, a pair of paper ejection rollers 17 and a paper ejection tray 18 are disposed. The paper ejection rollers 17 eject a sheet P outside the process unit 1, and the sheet P ejected by the paper ejection rollers 17 is stacked on the paper ejection tray 18.

Moreover, the apparatus body 100 includes a conveyance path R on which a sheet P is conveyed from the sheet feed tray 15 to the paper ejection tray 18 via the secondary transfer nip. On the conveyance path R, a pair of registration rollers 19 serving as timing rollers are disposed on an upstream side of the secondary transfer roller 12 in a sheet conveyance direction. The pair of registration rollers 19 times the conveyance of the sheet P to the secondary transfer nip. Moreover, a fixing device 20 for fixing an image on the sheet P is disposed on a downstream side of the secondary transfer roller 12 in the sheet conveyance direction.

Next, basic operation of the color laser printer 1000 according to the present exemplary embodiment is described with reference to FIG. 1. When the color laser printer 1000 starts an image forming operation, each of the photoconductors 2 of the respective process units 1 is rotated counterclockwise. The surfaces of the photoconductors 2 are uniformly charged with a predetermined polarity by the respective charging rollers 3. Subsequently, the charged surfaces of the photoconductors 2 are irradiated with laser beams from the respective exposure devices 6 based on image information of a document read by an image reading device, thereby forming electrostatic latent images on the surfaces of the photoconductors 2. Herein, the image information used for exposure of the photoconductors 2 to the laser beams includes single color image information obtained by color separation of a desired full-color image into yellow, magenta, cyan, and black. Accordingly, when toners are supplied from the developing devices 4 to the electrostatic latent images formed on the respective photoconductors 2, the electrostatic latent images are developed (visualized) as toner images.

Moreover, when the color laser printer 1000 stars the image forming operation, the drive roller 9 tightly stretching the intermediate transfer belt 8 is rotated. The rotation of the drive roller 9 starts to rotate the intermediate transfer belt 8. Each of the primary transfer rollers 11 receives a constant voltage or a constant-current controlled voltage having a polarity opposite to a charging polarity of the toner, so that transfer electric fields are formed in primary transfer areas between the primary transfer rollers 11 and the respective photoconductors 2.

Subsequently, with the rotation of the photoconductors 2, the toner images of different colors on the respective photoconductors 2 reach the respective primary transfer areas. When reaching the primary transfer areas, the toner images on the photoconductors 2 are sequentially superimposed on the intermediate transfer belt 8 by the transfer electric fields formed in the respective primary transfer areas. This enables the surface of the intermediate transfer belt 8 to bear a full-color toner image. The cleaning blades 5 (5Y, 5M, 5C, 5Bk) remove toner from the surfaces of the respective photoconductors 2, the toner remaining on the photoconductors 2 without being transferred to the intermediate transfer belt 8.

In the lower portion of the apparatus body 100, the feed roller 16 starts to rotate, and a sheet P is fed from the sheet feed tray 15 to the conveyance path R. The pair of registration rollers 19 temporarily stops the conveyance of the sheet P fed to the conveyance path R.

Subsequently, the pair of registration rollers 19 starts to rotate at predetermined timing to convey the sheet P to the secondary transfer nip. The pair of registration rollers 19 times the conveyance of the sheet P to coincide with the arrival of the toner image on the intermediate transfer belt 8 at the secondary transfer nip. Herein, a transfer voltage is applied to the secondary transfer roller 12, the transfer voltage having a polarity opposite to a toner charging polarity of the toner image on the intermediate transfer belt 8. With the transfer voltage, the transfer electric field is formed in the secondary transfer nip. This transfer electric field enables the toner image on the intermediate transfer belt 8 to be collectively transferred to the sheet P. The belt cleaning device 13 removes a residual toner from the intermediate transfer belt 8, the residual toner remaining on the intermediate transfer belt 8 without being transferred to the sheet P. The removed toner is conveyed to and collected by the waste toner container 14.

Then, the sheet P with the transferred toner image is conveyed to the fixing device 20 in which the toner image is fixed on the sheet P. Then, the sheet P is ejected by the pair of paper ejection rollers 17 and stacked on the paper ejection tray 18.

Such an image forming operation is performed when the color laser printer 1000 forms a full-color image on a sheet P. However, the color laser printer 1000 may use any one of the four process units 1Y, 1M, 1C, and 1Bk to form a single color image. Alternatively, the color laser printer 1000 may use two or three of the process units 1Y, 1M, 1C, and 1Bk to form a two-color image or a three-color image.

As illustrated in FIG. 1, the color laser printer 1000 according to the present exemplary embodiment includes a cover 101 disposed on the top of the apparatus body 100. The cover 101 is opened and closed. The cover 101 is vertically rotatable around a pivot 103 provided on the apparatus body 100. In a lower portion of the cover 101, a cartridge holder 102 serving as a container holder for detachably holding the four toner cartridges 30 is disposed. The cartridge holder 102 is vertically rotatable around a pivot 104 provided on the apparatus body 100.

Figure 2:
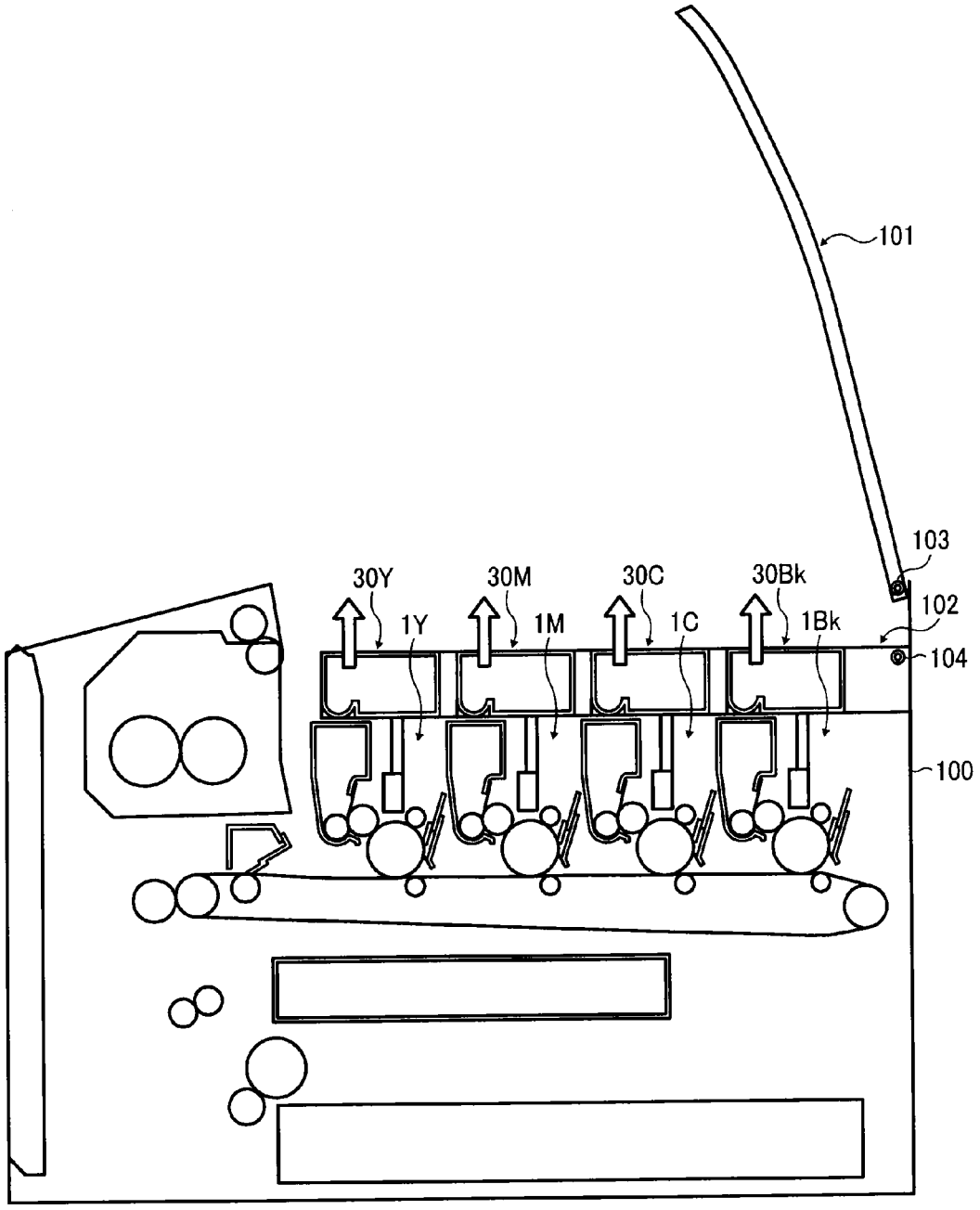
FIG. 2 is a diagram of the image forming apparatus when an upper cover of the image forming apparatus is rotated upward and opened.
Figure 3:
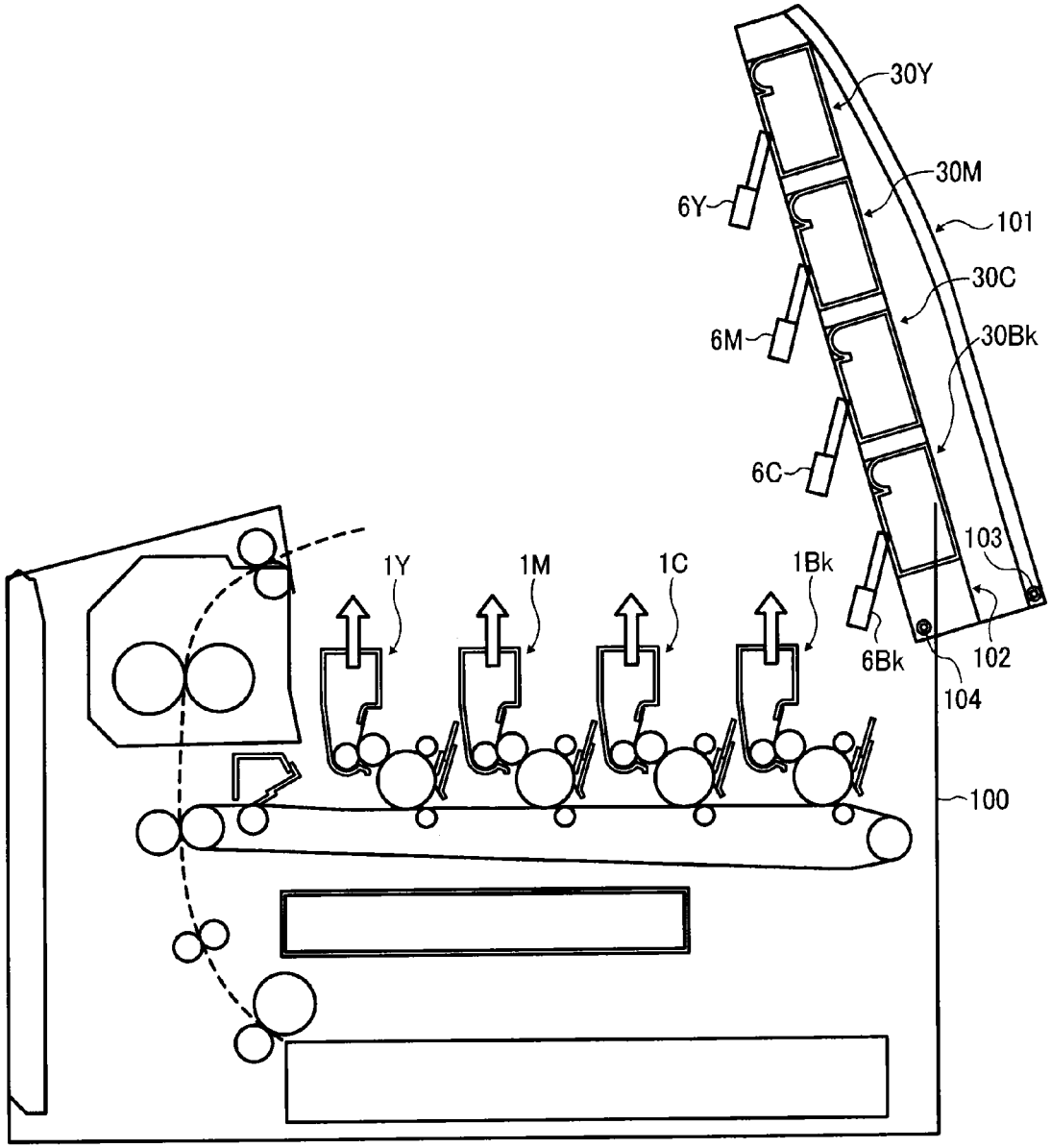
FIG. 3 is a diagram of the image forming apparatus when the upper cover and a cartridge holder are rotated upward.

FIG. 2 is a diagram of the apparatus body 100 when the cover 101 is rotated upward and opened, whereas FIG. 3 is a diagram of the apparatus body 100 when the cover 101 and the cartridge holder 102 are rotated upward. As illustrated in FIG. 2, when the cover 101 is opened, the apparatus body 100 has open space thereabove. This enables each of the toner cartridges 30 to be removed upward from the cartridge holder 102 though the open space.

Moreover, as illustrated in FIG. 3, when the cartridge holder 102 is rotated upward from a reference position in which the cartridge holder 102 is horizontal, the toner cartridges 30 and the cartridge holder 102 are retracted (separated) from a position above the process units 1Y, 1M, 1C, and 1Bk to a retracted position. Moreover, each of the exposure devices 6 is attached to the bottom of the cartridge holder 102. When the cartridge holder 102 is rotated upward, the exposure devices 6 are also retracted from the position above the process units 1Y, 1M, 1C, and 1Bk. Accordingly, when the cartridge holder 102 is rotated upward to the retracted position, the process units 1Y, 1M, 1C, and 1Bk can be removed through the open space provided above the apparatus body 100 without interfering with the toner cartridges 30 and the exposure devices 6.

Figure 4:
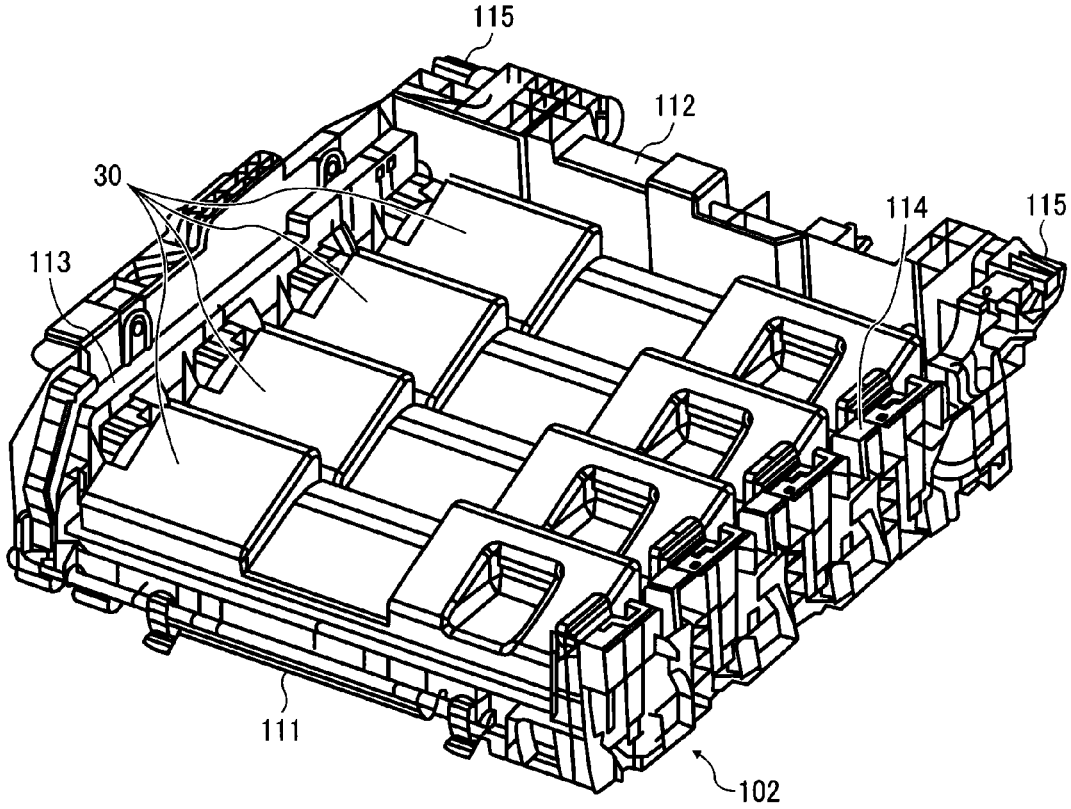
FIG. 4 is a perspective view of the cartridge holder.

FIG. 4 is a perspective view of the cartridge holder 102. As illustrated in FIG. 4, the cartridge holder 102 includes a substantially rectangular bottom 111, a back wall 112, and a pair of opposed side walls 113 and 114. The back wall 112 is disposed on one side of the bottom 111. The pair of side walls 113 and 114 is disposed on two opposite sides of the bottom 111 intersecting with the back wall 112. The toner cartridges 30 are attached parallel to each other between the side walls 113 and 114. The back wall 112 includes a tubular bearing unit 115 into which the pivot 104 is inserted.

Figure 5:
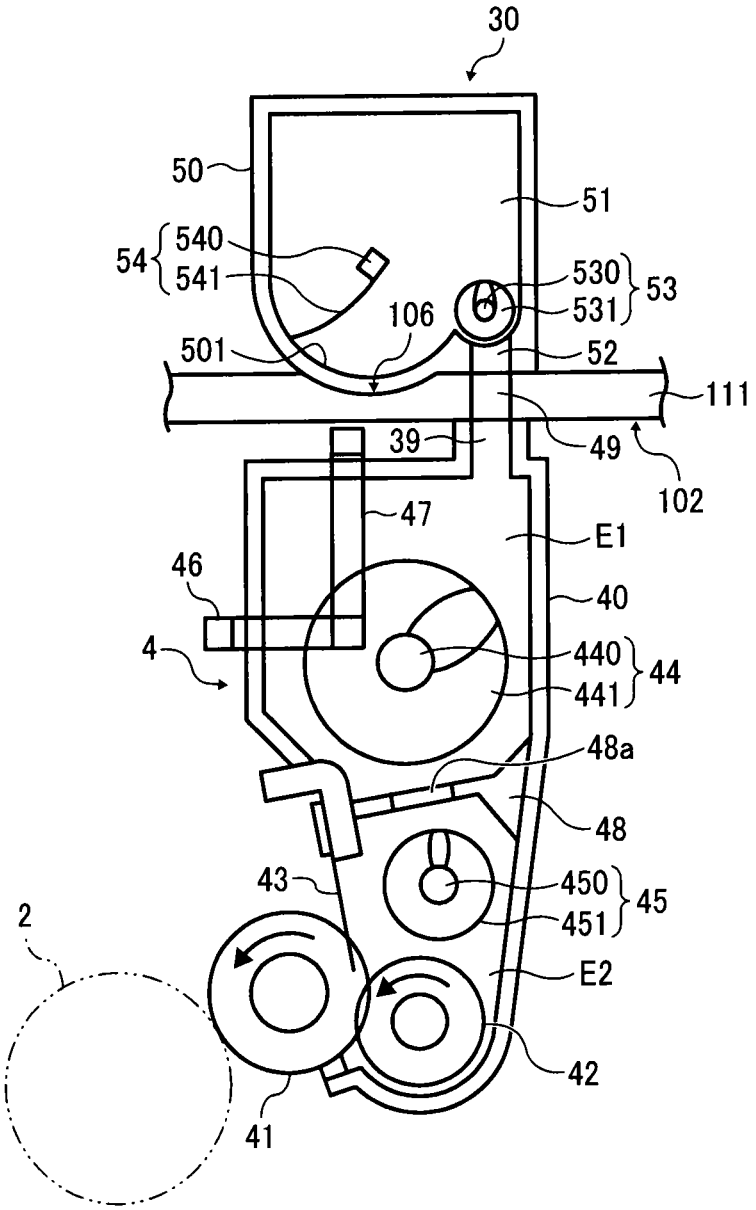
FIG. 5 is a sectional view showing a configuration of a toner cartridge and a developing device.

FIG. 5 is a sectional view of a configuration of the toner cartridge 30 and the developing device 4. As illustrated in FIG. 5, the toner cartridge 30 includes a container body 50 including a developer container 51 for storing toner. The container body 50 includes a discharge port 52 serving as an opening, a conveyance screw 53 serving as a conveyance member, and an agitator 54 serving as a stirring member. The discharge port 52 discharges the toner inside the developer container 51 to the outside. The conveyance screw 53 conveys the toner inside the developer container 51 to the discharge port 52. The agitator 54 stirs the developer inside the developer container 51. The discharge port 52 is disposed in a lower portion of the developer container 51.

The conveyance screw 53 includes a helical blade 531 and a rotation shaft 530. The blade 531 is provided on an outer circumference of the rotation shaft 530. The agitator 54 includes a rotation shaft 540 and a deformable planar blade 541. The rotation shaft 540 is disposed parallel to the rotation shaft 530 of the conveyance screw 53, and the blade 541 is provided on the rotation shaft 540. The blade 541 of the agitator 54 is made of a flexible material such as a polyethylene terephthalate (PET) film. As illustrated in FIG. 5, a bottom 501 of the developer container 51 is formed in an arc shape along a circular trajectory of the blade 541. The blade 541 can reduce an amount of toner that remains inside the developer container 51 without being moved.

At the bottom 111 of the cartridge holder 102 to which the toner cartridge 30 is attached, a through hole 49 is provided so that the discharge port 52 of the toner cartridge 30 and a supply port 39 of the developing device 4 communicate with each other. As illustrated in FIG. 5, the toner cartridge 30 is attached to the cartridge holder 102 and disposed above the process unit 1. Such arrangement connects the discharge port 52 of the toner cartridge 30 and the supply port 39 of the developing device 4 to communicate with each other through the through hole 49. Thus, toner can be supplied from the toner cartridge 30 to the developing device 4.

The developing device 4 includes a developer housing 40, a developer roller 41, a supply roller 42, a developer blade 43, two conveyance screws 44 and 45, and two light guide members 46 and 47. The developer housing 40 stores toner. The developer roller 41 serving as a developer bearer bears toner. The supply roller 42 serving as a developer supply member supplies toner to the developer roller 41. The developer blade 43 serving as a regulation member regulates an amount of the toner on the developer roller 41. The conveyance screws 44 and 45 serving as a conveyance members convey toner.

The developer housing 40 includes a partition wall 48 including a communication port 48*a*. The partition wall 48 divides an area inside the developer housing 40 into two areas that are a first area E1 and a second area E2. In FIG. 5, the first area E1 is an upper portion of the developer housing 40, whereas the second area E2 is a lower portion of the developer housing 40. The communication port 48*a* is provided on each of both ends of the partition wall 48 (a front side and a rear side in a direction perpendicular to a sheet surface in FIG. 5). That is, the first area E1 and the second area E2 communicate with each other in locations of the two communication ports 48*a*.

In the first area E1, the light guide members 46 and 47 and the conveyance screw 44 are disposed. In the second area E2, the developer roller 41, the supply roller 42, the developer blade 43, and the other conveyance screw 45 are disposed. The conveyance screws 44 and 45 include respective helical blades 441 and 451 on outer circumferences of respective rotation shafts 440 and 450. The conveyance screws 44 and 45 are rotated to convey toner in opposite directions.

The toners conveyed in the opposite directions by the conveyance screws 44 and 45 reach downstream ends of the respective first and second areas E1 and E2 in conveyance directions, and then pass the communication ports 48*a* formed on the both ends of the partition wall 48. Subsequently, the toner is fed from one area to the other area (i.e., from the first area E1 to the second area E2, or from the second area E2 to first area E1). Therefore, the toner is conveyed to circulate between the first area E1 and the second area E2. This enables toner newly supplied form the toner cartridge 30 and the toner inside the developer housing 40 to be mixed together, so that a toner state (the proportion of the new toner to the mixed toner) becomes uniform. Consequently, this can prevent a problem such as color unevenness and background fog.

The developer roller 41 is constructed of a metal core and a coating of conductive rubber around the core. In the present exemplary embodiment, the core has an outer diameter (ϕ) of 6 mm, and the conductive rubber has an outer circumferential diameter (ϕ) of 12 mm and a rubber hardness of Hs 75. The conductive rubber has a volume resistance that is adjusted to be approximately 105Ω to approximately 107Ω. The conductive rubber can be made of conductive urethane or silicone rubber. The developer roller 41 rotates in a counterclockwise direction in FIG. 5 to convey the developer thereon to the developer blade 43 and a position opposite the photoconductor 2.

The supply roller 42 generally includes a sponge roller. The sponge roller suitably includes polyurethane foam that adheres to an outer circumference of a metal core, the polyurethane foam being a carbon-mixture polyurethane foam having semi-conductivity. In the present exemplary embodiment, the core has an outer diameter (ϕ) of 6 mm, and the sponge portion has an outer diameter (ϕ) of 12 mm. The supply roller 42 contacts the developer roller 41. The supply roller 42 and the developer roller 41 contact each other to form an area of contact called herein a nipping portion therebetween, and the nipping portion generally has an extent of approximately 1 mm to approximately 3 mm. In the present exemplary embodiment, the extent of the nipping portion between the supply roller 42 and the developer roller 41 is set to 2 mm. Moreover, the supply roller 42 rotates in a counterclockwise direction in FIG. 5 with respect to the developer roller 41 such that the toner inside the developer housing 40 is efficiently supplied to a surface layer of the developer roller 41. In the present exemplary embodiment, a ratio of the developer roller 41 to the supply roller 42 is set to 1:1 to ensure good toner supply capability.

The developer blade 43 includes, for example, a metal plate such as stainless used steel (SUS) having a thickness of approximately 0.1 mm. The developer blade 43 has a leading edge that contacts a surface of the developer roller 41. The developer blade 43 controls an amount of the toner on the developer roller 41, and such control serves as important parameters not only to stabilize development characteristics but also to obtain good image quality. In a normal product, the developer blade 43 is strictly controlled to have a contact pressure of approximately 20 N to approximately 60 N with respect to the developer roller 41, whereas a position of the nipping portion is strictly controlled to 0.5 mm with approximately ±0.5 mm from the leading edge of the developer blade 43. These parameters are determined as needed according to characteristics of toner to be used, the developer roller 41, and the supply roller 42. In the present exemplary embodiment, the developer blade 43 includes a SUS member having a thickness of 0.1 mm, and a contact pressure is set to 45 N/m. Moreover, a position of the nipping portion is set to 0.2 mm from the leading edge of the developer blade 43, and a length (a free length) from a supporting end to a free end (the leading end) of the developer blade 43 is set to 14 mm. These settings enable a thin toner layer to be stably formed on the developer roller 41.

A development operation performed by the developing device 4 is described with reference to FIG. 5. When the color laser printer 1000 issues an image formation start instruction, the developer roller 41 and the supply roller 42 start to rotate. With the rotation of the supply roller 42, toner is supplied to a surface of the developer roller 41. This enables the surface of the developer roller 41 to bear the toner. When the toner on the developer roller 41 passes a nipping portion between the developer roller 41 and the developer blade 43, a thickness of a toner layer is regulated. At the same time, the toner is triboelectrically charged. Then, when the toner on the developer roller 41 is conveyed to a position opposite the photoconductor 2 (the position is called a developing area), the toner is electrostatically transferred to an electrostatic latent image on the photoconductor 2 to form a toner image.

Next, an operation for supplying toner to the developing device 4 is described. The toner is supplied to the developing device 4 if an amount of the toner inside the developer housing 40 declines to a predetermined threshold value or less. Particularly, a determination of whether the toner amount is the threshold value or less is made based on whether light is transmitted through leading edges of the light guide members 46 and 47 disposed in the first area E1. If the toner amount in the developer housing 40 is the threshold value or greater, the toner is interposed in each of the light guide members 46 and 47. In such a case, the light is not transmitted from one of the light guide members 46 and 47 to the other. On the other hand, if the toner amount is the threshold value or less, the toner is not interposed in each of the light guide members 46 and 47. In such a case, the light is transmitted from one of the light guide members 46 and 47 to the other. Detection of such light transmission enables appropriate toner supply timing to be ascertained.

If it is determined that the appropriate toner supply timing has come, the conveyance screw 53 inside the toner cartridge 30 starts to rotate. The rotation of the conveyance screw 53 conveys toner toward the discharge port 52. Then, the toner is supplied from the discharge port 52 to the developer housing 40 via the through hole 49 and the supply port 39. Moreover, when the toner is supplied, the agitator 54 rotates. The rotation of the agitator 54 not only stirs the toner inside the toner cartridge 30, but also conveys the toner to a rotation area of the conveyance screw 53. When the toner amount inside the developer housing 40 exceeds the predetermined threshold value with the supplied toner, the conveyance screw 53 and the agitator 54 stop rotating. Thus, the toner supply operation ends.

Figure 6:
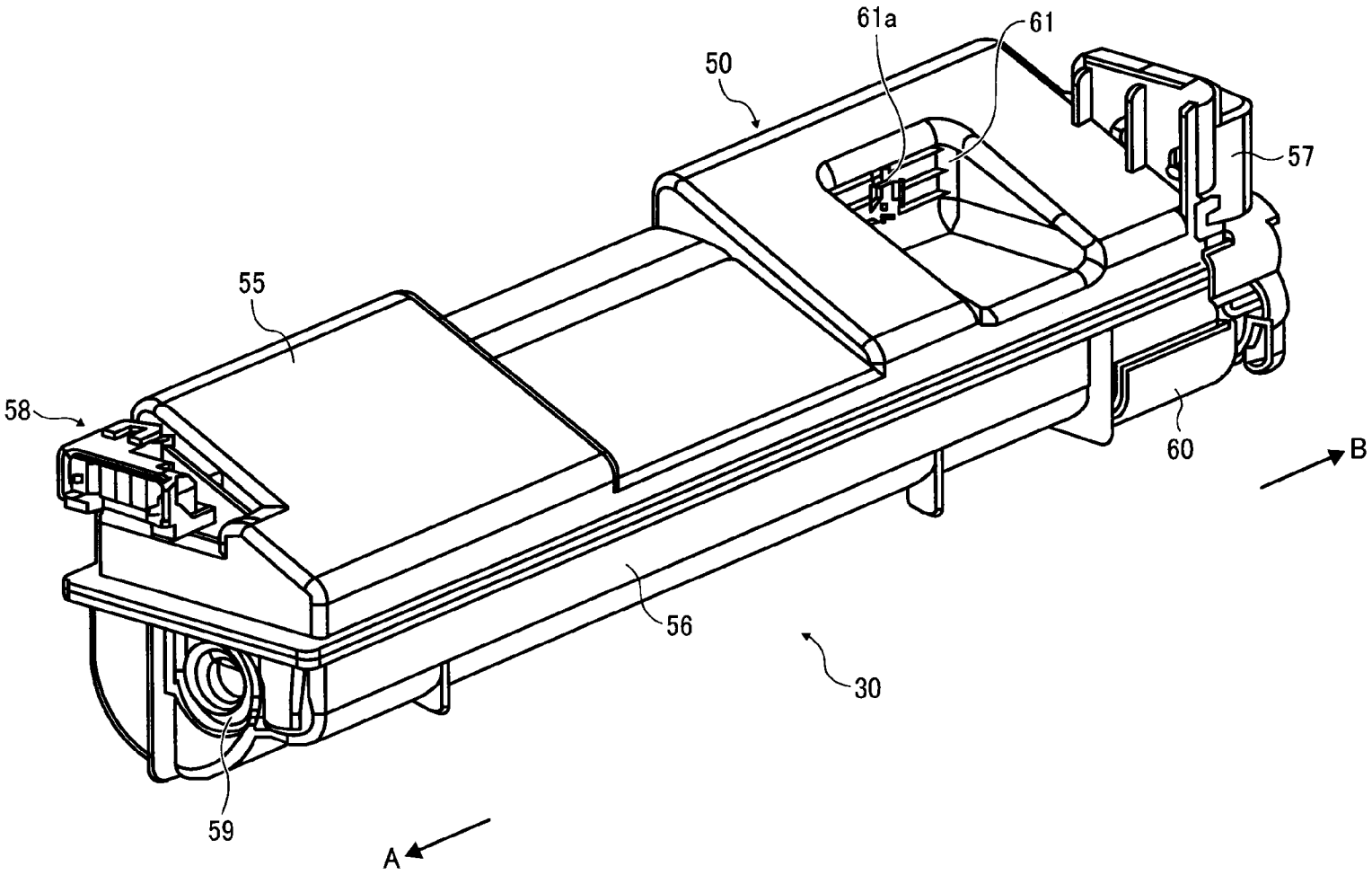
FIG. 6 is an external view of the toner cartridge.
Figure 7:
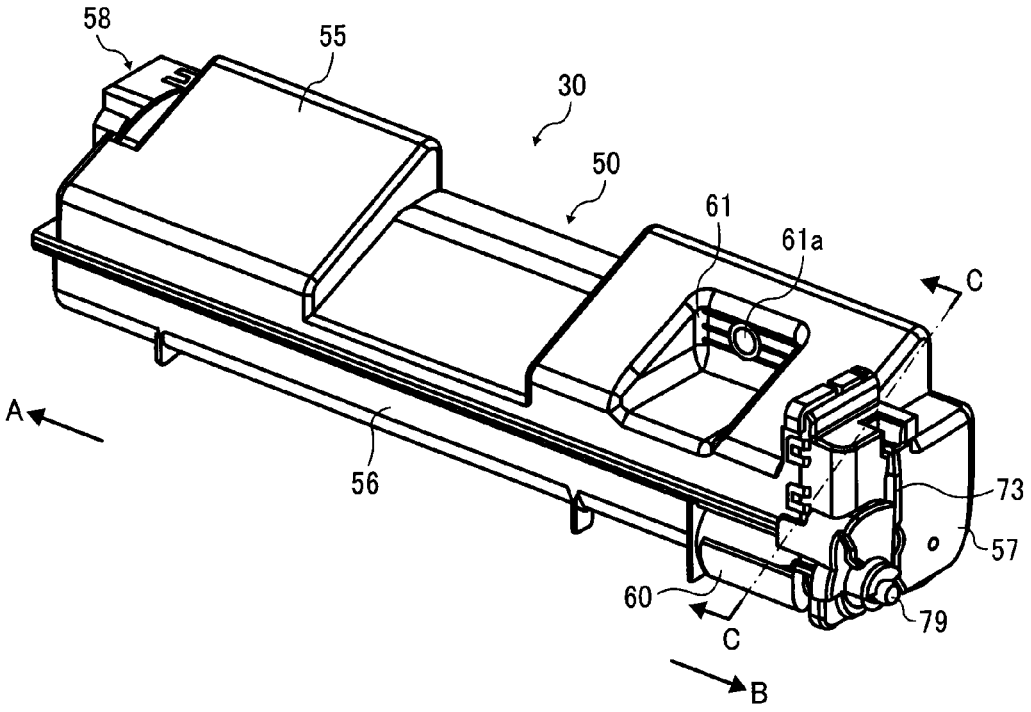
FIG. 7 is an external view of the toner cartridge.

FIGS. 6 and 7 are external views of the toner cartridge 30. FIG. 6 is a perspective view of the toner cartridge 30 as seen from one end side (an end in a direction indicated by an arrow A), whereas FIG. 7 is a perspective view of the toner cartridge 30 as seen from the other end side (an end in a direction indicated by an arrow B).

As illustrated in FIGS. 6 and 7, the container body 50 of the toner cartridge 30 includes an upper case 55 and a lower case 56. These cases 55 and 56 are bonded together by welding, such as vibration welding or ultrasonic welding, or adhesion with two-sided adhesive tape or adhesive.

The container body 50 includes a container side terminal 58 and a cap 59 that are attached to one end side (in the direction A) thereof. After the toner cartridge 30 is filled with toner through a filling port, the cap 59 seals the filling port to prevent leakage of the toner from the filling port. The container body 50 includes a gear cover 57 and an outer shutter 60, serving as a shutter, disposed on the other end side (in the direction B) thereof. The gear cover 57 covers the end side in the direction B. Moreover, the container body 50 includes a handle-shaped gripping unit 61 disposed nearer to the end side (in the direction B) than the center in a longitudinal direction thereof. When the toner cartridge 30 is replaced, a user holds the gripping unit 61, so that the toner cartridge 30 can be readily attached and detached. The gripping unit 61 includes an annular rib **61*a* on an inner surface thereof such that the user is readily aware of the gripping unit 61**.

Figure 8:
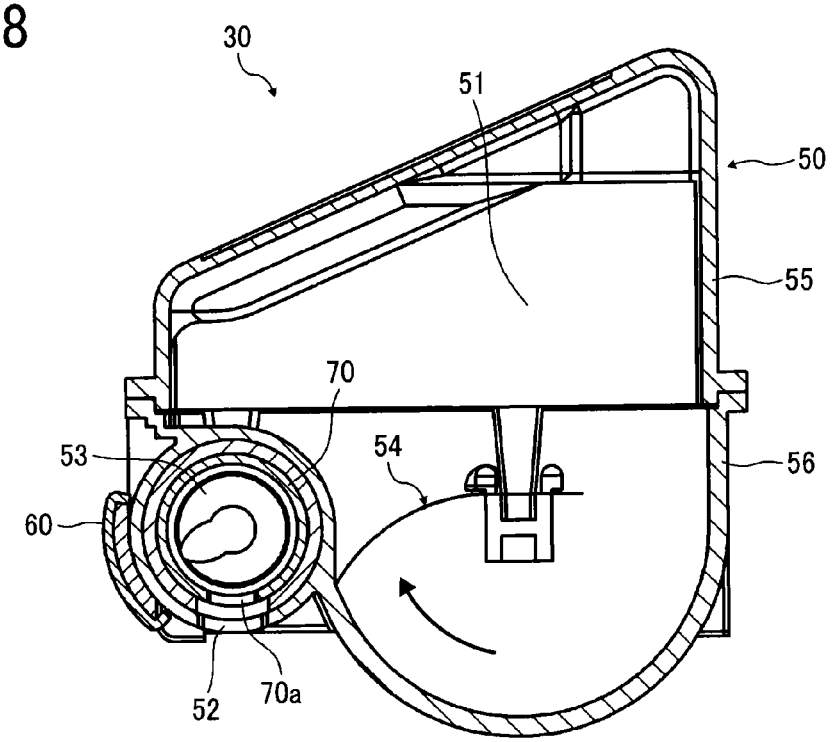
FIG. 8 is a sectional view along line C-C of FIG. 7.

FIG. 8 is a sectional view of the toner cartridge 30 along line C-C of FIG. 7. As illustrated in FIG. 8, the toner cartridge 30 includes an inner shutter 70 serving as a shutter unit for opening and closing the discharge port 52 in addition to the outer shutter 60 disposed outside the discharge port 52. The inner shutter 70 is disposed inside the discharge port 52. That is, the toner cartridge 30 has a double shutter structure with the outer shutter 60 and the inner shutter 70 respectively disposed outside and inside the discharge port 52.

The inner shutter 70 is a cylindrical rotation shutter, and includes a developer outlet **70*a* formed on one portion in a circumferential direction thereof. The developer outlet 70*a* passes through a radial direction of the inner shutter 70. The inner shutter 70 rotates around an axis thereof, so that a position of the developer outlet 70*a* can be changed between an open position and a closed position. In the open position, the developer outlet 70*a* is disposed opposite the discharge port 52. In the closed position, the developer outlet 70*a* is not disposed opposite the discharge port 52 (a circumferential wall and the discharge port 52** overlap).

The outer shutter 60, serving as a rotation shutter, rotates concentrically with the inner shutter 70. With the rotation, the outer shutter 60 can switch between a closed position and an open position. In the closed position, the outer shutter 60 is disposed opposite the discharge port 52 to close the discharge port 52. In the open position, the outer shutter 60 is retracted from the closed position to open the discharge port 52.

Figure 9:
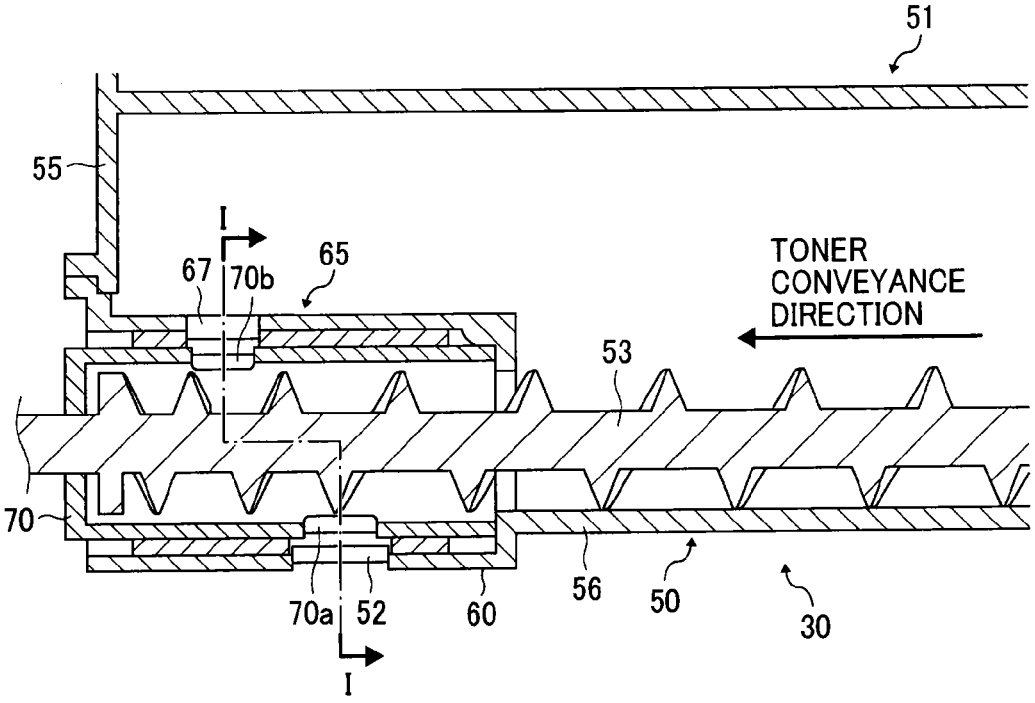
FIG. 9 is a sectional view of the toner cartridge taken along an axial direction of a conveyance screw in a position thereof.

FIG. 9 is a sectional view of the toner cartridge 30 along an axial direction of the conveyance screw 53. As illustrated in FIG. 9, a semi-cylindrical hood portion 65 is disposed on an outer diameter side of the inner shutter 70. The inner shutter 70 is rotatably held between the hood portion 65 and an inner wall of the container body 50. Accordingly, the arrangement of the hood portion 65 enables an inner cylindrical surface thereof to function as a bearing for rotatably supporting the inner shutter 70, thereby stabilizing a rotational orientation of the inner shutter 70. Moreover, the hood portion 65 includes a return port 67 for returning the toner inside the inner shutter 70 to the developer container 51.

Moreover, the inner shutter 70 includes a return port 70*b* for returning the toner inside the inner shutter 70 to the developer container 51, as similar to the hood portion 65. The return port 70*b* of the inner shutter 70 is disposed on a downstream side of the developer outlet 70*a* in a toner conveyance direction.

One portion of the conveyance screw 53 is inserted into the inner shutter 70. Thus, when the conveyance screw 53 rotates, toner is conveyed from the developer container 51 to the inner shutter 70 by the conveyance screw 53. When the discharge port 52 is opened, the toner conveyed inside the inner shutter 70 is discharged to the outside (the developing device 4 side) via the developer outlet 70*a* of the inner shutter 70 and the discharge port 52. However, in a case where the discharge of toner is slowed due to clogging of the discharge port 52 with the toner, continuous conveyance of the toner into the inner shutter 70 may deteriorate the toner due to a load or damage the conveyance screw 53 due to a load.

Accordingly, in the present exemplary embodiment, the return port 70*b* of the inner shutter 70 is disposed opposite the return port 67 of the hood portion 65, so that the toner inside the inner shutter 70 can return to the developer container 51 via the return ports 70*b* and 67. This can suppress application of loads to the toner and the conveyance screw 53, thereby preventing deterioration of the toner and damage to the conveyance screw 53.

Figure 10A:
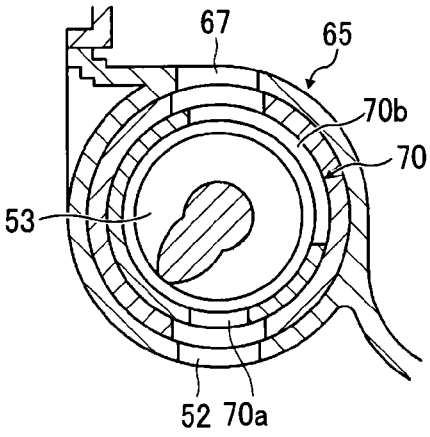
FIGS. 10A and 10B are sectional views along line I-I of FIG. 9.
Figure 10B:
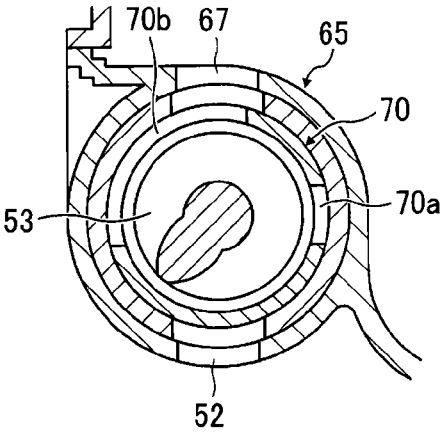

FIGS. 10A and 10B are sectional views along line I-I of FIG. 9. As illustrated in FIGS. 10A and 10B, the return port 70*b* of the inner shutter 70 is formed to extend in a circumferential direction of the inner shutter 70. Thus, one portion of the return port 70*b* of the inner shutter 70 overlaps the return port 67 of the hood portion 65 when the discharge port 52 is opened (a state illustrated in FIG. 10A) and closed (a state illustrated in FIG. 10B). Therefore, the toner is returned to the developer container 51 using the return ports 70*b* and 67 regardless of whether the discharge port 52 is opened.

Figure 11:
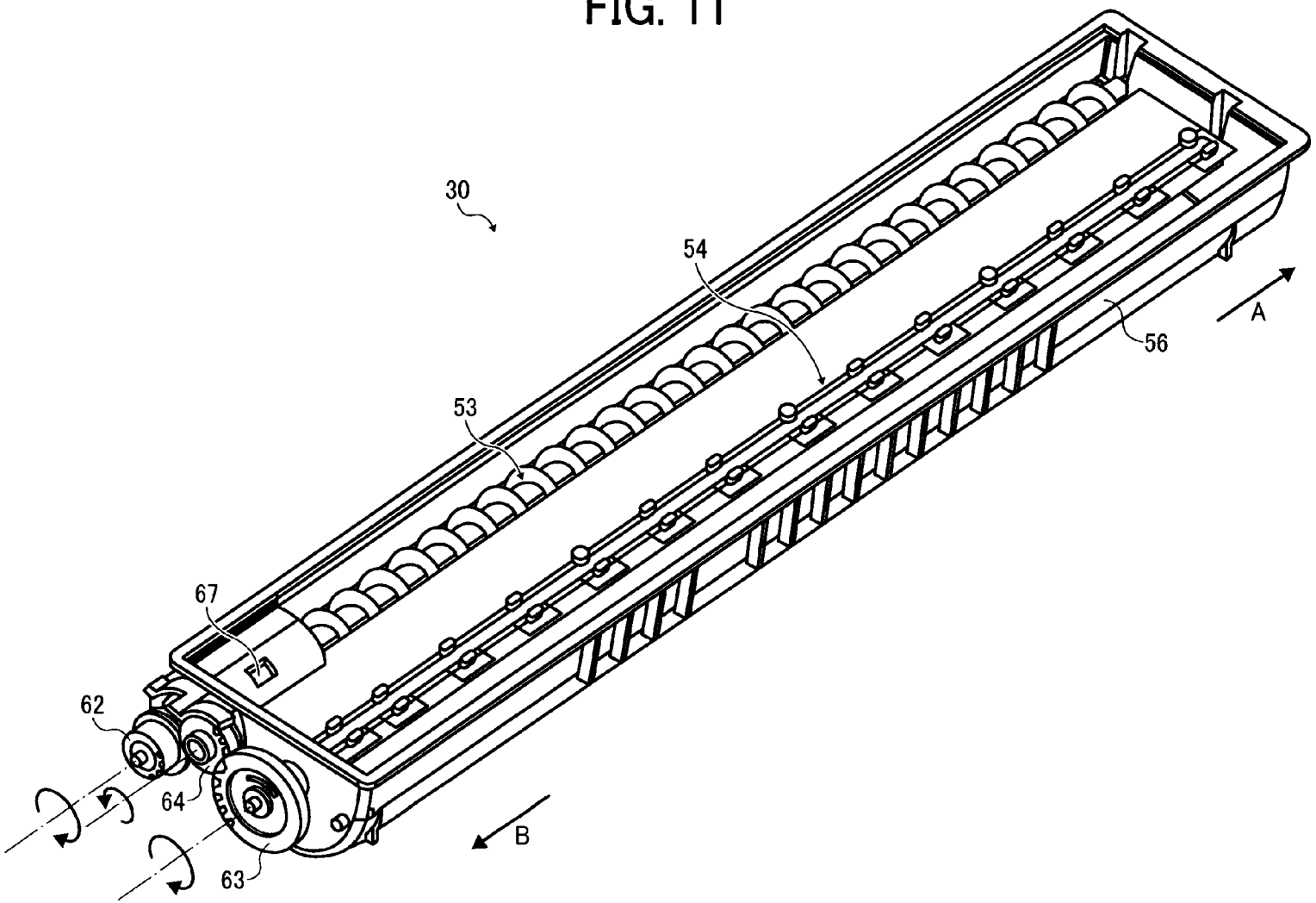
FIG. 11 is a perspective view of the toner cartridge when an upper case and a gear cover are removed.

FIG. 11 is a perspective view of the toner cartridge 30 with the upper case 55 and the gear cover 57 removed. In FIG. 11, the toner cartridge 30 includes a conveyance drive gear 62, a stirring drive gear 63, and a torque transmission gear 64 that are housed in the gear cover 57. The conveyance drive gear 62 and the stirring drive gear 63 are attached to rotation shafts of the conveyance screw 53 and the agitator 54, respectively. The rotation shafts of the conveyance screw 53 and the agitator 54 protrude outward from a side surface on the end (in the direction B) of the lower case 56. The torque transmission gear 64 meshes with the conveyance drive gear 62 and the stirring drive gear 63 to transmit running torque.

Figure 17A:
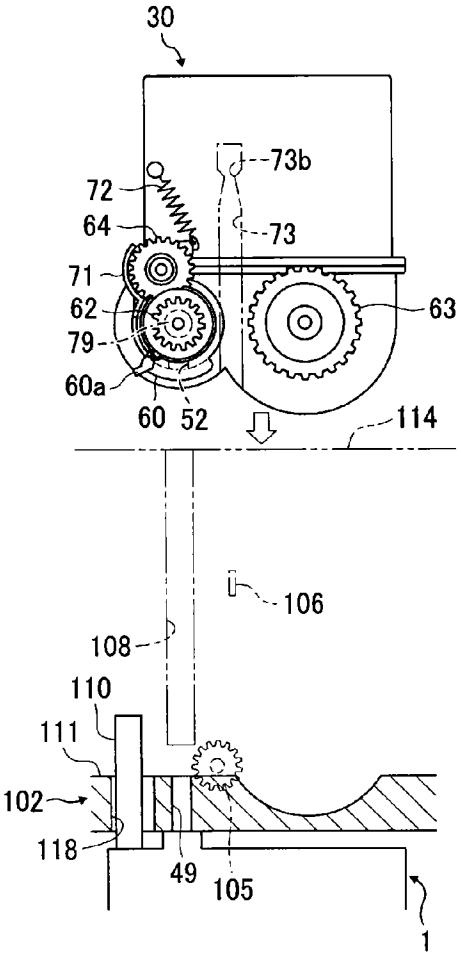
FIGS. 17A, 17B, and 17C are side views illustrating attachment of the toner cartridge to the cartridge holder.
Figure 17B:
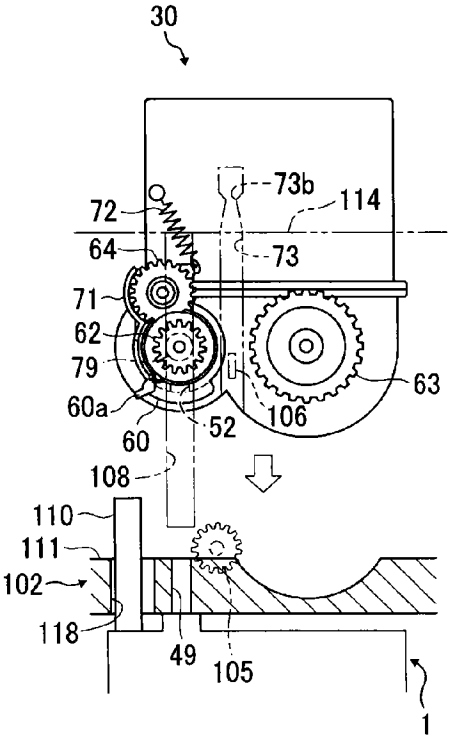
Figure 17C:
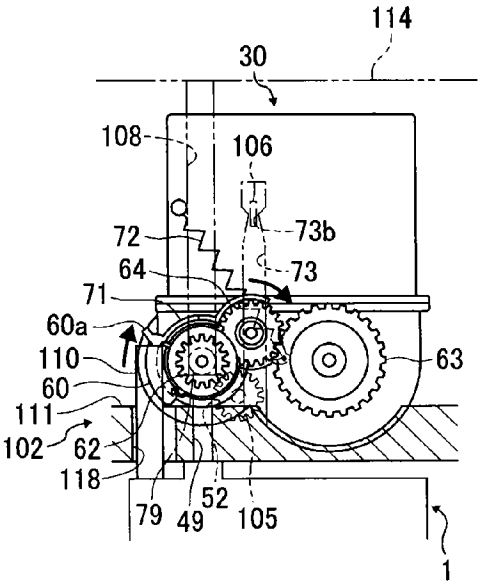

When the toner cartridge 30 is attached to the cartridge holder 102, the conveyance drive gear 62 meshes with a body-side drive gear 105 disposed to the cartridge holder 102 (see FIG. 17C). In this state, if the body-side drive gear 105 is rotated, the conveyance drive gear 62, the stirring drive gear 63, and the torque transmission gear 64 rotate in directions indicated by respective arrows illustrated in FIG. 11. Such rotation of the gears 62, 63, and 64 rotates the conveyance screw 53 and the agitator 54.

Figure 12:
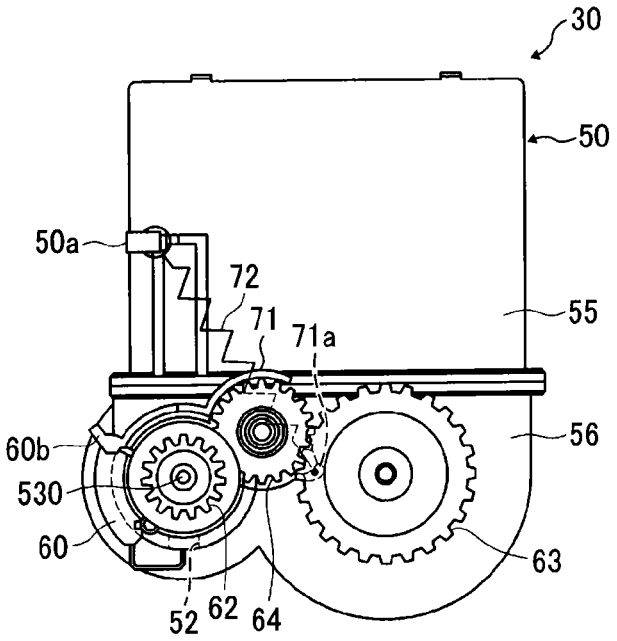
FIG. 12 is a side view of the toner cartridge when the gear cover is removed.
Figure 13:
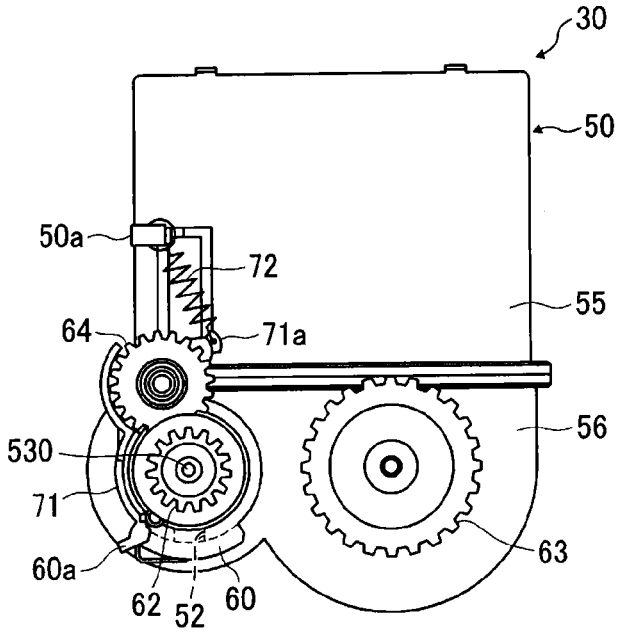
FIG. 13 is a side view of the toner cartridge when the gear cover is removed.

FIGS. 12 and 13 are side views of the toner cartridge 30 when the gear cover 57 is removed. In the present exemplary embodiment, the torque transmission gear 64 is movable between an operating position as illustrated in FIG. 12 and a retracted position as illustrated in FIG. 13. In the operating position, the torque transmission gear 64 meshes with the conveyance drive gear 62 and the exposure stirring drive gear 63 to transmit torque. In the retracted position, the torque transmission gear 64 is released from the conveyance drive gear 62 and the stirring drive gear 63.

The torque transmission gear 64 is rotatably held by a gear holder 71 integrally provided with the outer shutter 60. Moreover, a tension spring 72 is attached between the gear holder 71 and the container body 50. One end of the tension spring 72 is attached to a latch 71*a* of the gear holder 71, and the other end of the tension spring 72 is attached to a latch 50*a* provided on a side surface of the upper case 55. With tensile force (urging force) of the tension spring 72, the gear holder 71 urges the torque transmission gear 64 toward a direction away from the stirring drive gear 63. Therefore, when external force is not acting on the gear holder 71, the tensile force of the tension spring 72 moves the torque transmission gear 64 to the retracted position illustrated in FIG. 13.

Figure 14:
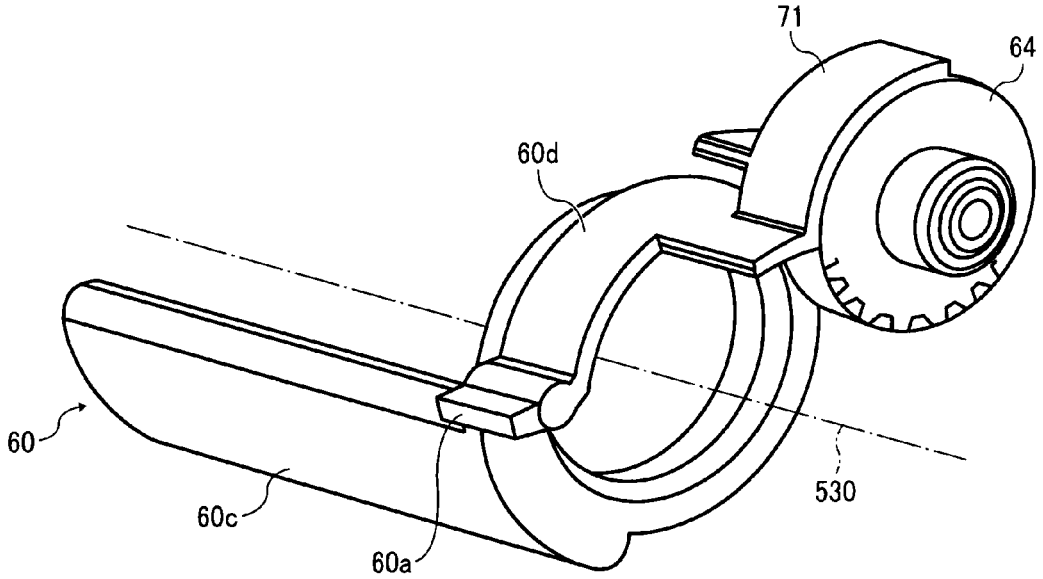
FIG. 14 is a perspective view of an outer shutter.

FIG. 14 is a perspective view of the outer shutter 60. The outer shutter 60 includes an annular supporting portion 60*d*, a shielding portion 60*c*, and an engaging portion 60*a*. The supporting portion 60*d* is supported by the container body 50, and rotatable around the rotation shaft 530 of the conveyance screw 53 (or the conveyance drive gear 62). The shielding portion 60*c* closes the discharge port 52. The engaging portion 60*a* engages an outer shutter switch 110 (see FIGS. 17A through 17C) to open the outer shutter 60. The outer shutter switch 110 is described below. The engaging portion 60*a* includes a protrusion that protrudes from the annular supporting portion 60*d* in an outer diameter direction thereof.

The outer shutter 60 is integrally provided with the gear holder 71. Accordingly, when the outer shutter 60 rotates in forward and reverse directions, the gear holder 71 rotates with the outer shutter 60. This changes a position of the torque transmission gear 64 between the operating position illustrated in FIG. 12 and the retracted position illustrated in FIG. 13. In the present exemplary embodiment, when the torque transmission gear 64 is in the operating position as illustrated in FIG. 12, the outer shutter 60 is retracted from a position opposite the discharge port 52 to a position that allows the discharge port 52 to be opened. On the other hand, when the torque transmission gear 64 is in the retracted position as illustrated in FIG. 13, the outer shutter 60 is disposed opposite the discharge port 52, so that the discharge port 52 is closed by the outer shutter 60.

Figure 15:
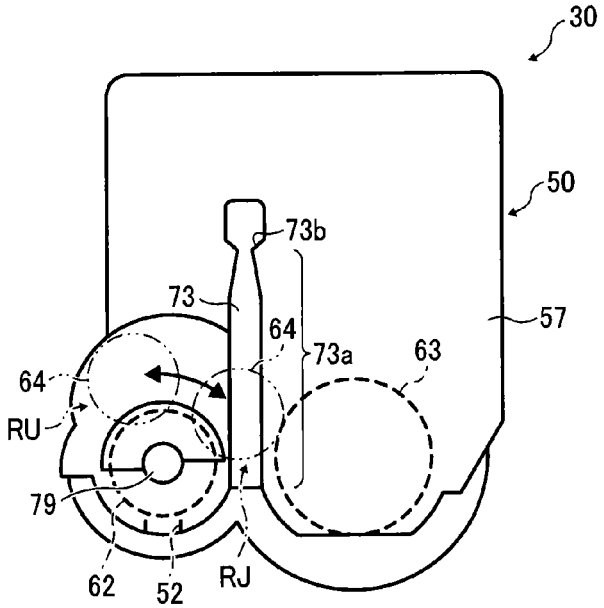
FIG. 15 is a side view of the toner cartridge as seen from the gear cover side.

FIG. 15 is a side view of the toner cartridge 30 as seen from the gear cover 57 side. As illustrated in FIG. 15, on the outer surface (a front surface) of the gear cover 57, a groove 73 and a protrusion member 79 are provided so that the toner cartridge 30 is guided and positioned with respect to the cartridge holder 102. The groove 73 extends in a vertical direction, and the protrusion member 79 has an outer circumferential surface with a circular section. The groove 73 includes a guide portion 73*a*, and a narrow positioning portion 73*b* continuously provided on the upper end of the guide portion 73*a*. The guide portion 73*a* opens at a lower portion, and a width of an upper portion of the guide portion 73*a* gradually narrows.

In FIG. 15, broken lines indicate projection regions of the conveyance drive gear 62, the torque transmission gear 64, and the stirring drive gear 63 with respect to the gear cover 57. The term "projection region" used herein represents a right-projection region in which a projected line with respect to each gear is parallel to an axial direction of the gear. In FIG. 15, a projection region of the torque transmission gear 64 in the operating position is indicated by a region RJ, whereas a projection region of the torque transmission gear 64 in the retracted position is indicated by a region RU. If the torque transmission gear 64 is in the operating position (in the region RJ), the torque transmission gear 64 is disposed to overlap the groove 73. Even in such a case, the torque transmission gear 64 does not overlap the positioning portion 73*b* of the groove 73. On the other hand, if the torque transmission gear 64 is in the retracted position (in the region RU), the torque transmission gear 64 is disposed in a position not to overlap the groove 73.

Figure 16:
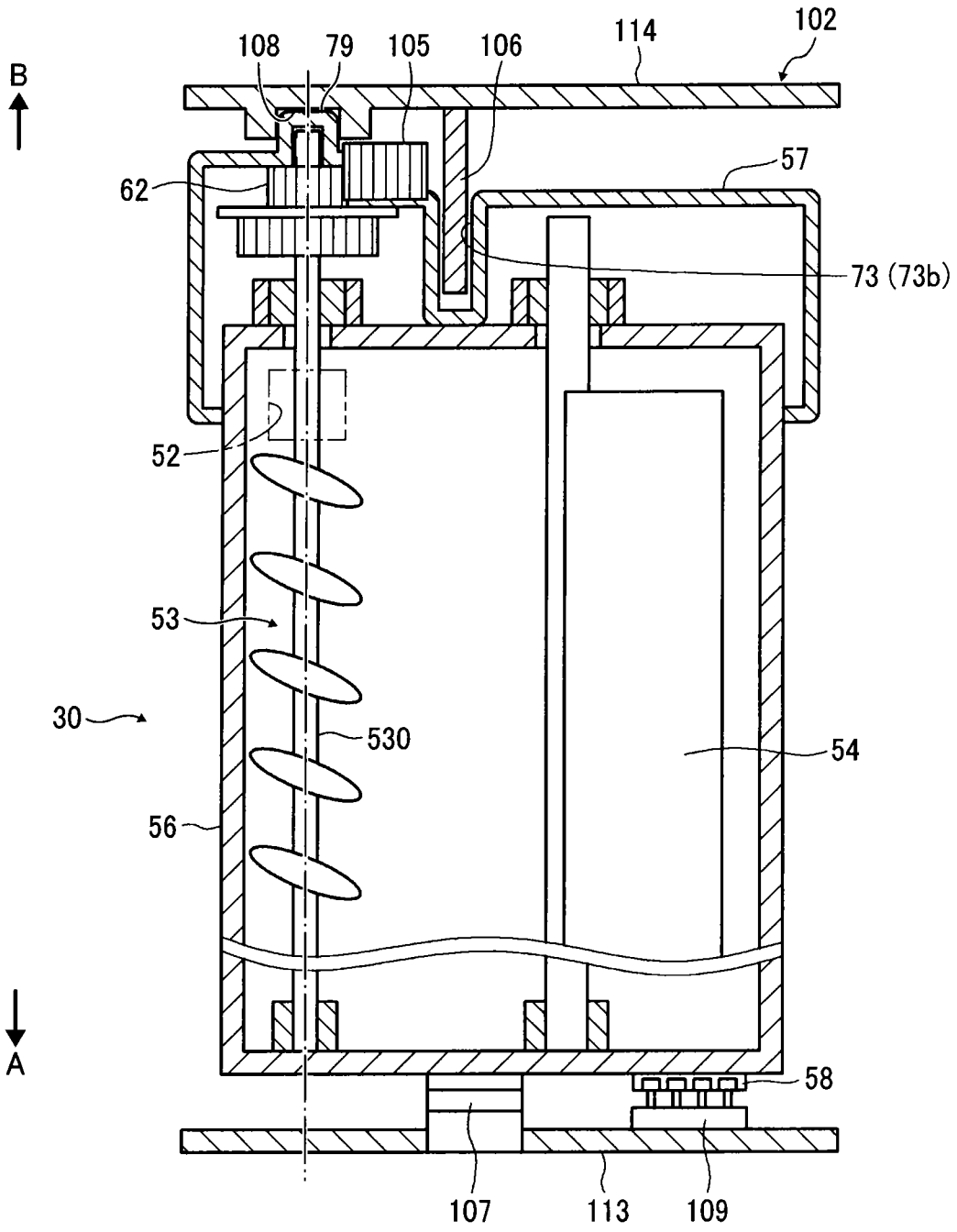
FIG. 16 is a sectional view of the toner cartridge attached to the cartridge holder, as seen from a lower side thereof.

FIG. 16 is a sectional view of the toner cartridge 30 attached to the cartridge holder 102, as seen from a lower side. The cartridge holder 102 includes the side walls 113 and 114. The side wall 114 being opposite to the gear cover 57 of the toner cartridge 30 includes a protrusion unit 106 that horizontally protrudes inward. The protrusion unit 106 can be inserted into the groove 73 formed in the gear cover 57. The side wall 114 being opposite to the gear cover 57 also includes a guide groove 108 that extends in a vertical direction. The protrusion member 79 provided on the gear cover 57 can be inserted into the guide groove 108.

On the other hand, the side wall 113 includes a body side terminal 109 that is in contact with and electrically connected to a container side terminal 58 of the toner cartridge 30. The side wall 113 also includes an urging member 107 such as a leaf spring to urge the toner cartridge 30 toward the side wall 114 side (toward the direction B) opposite the side wall 113.

FIGS. 17A through 17C illustrate attachment and detachment of the toner cartridge 30 to and from the cartridge holder 102 according to the present exemplary embodiment. When the toner cartridge 30 is attached to the cartridge holder 102, a user first opens the cover 101 of the apparatus body 100. Herein, the cartridge holder 102 is disposed in a horizontal reference position (in a state illustrated in FIG. 2). Then, the user attaches the toner cartridge 30 to the cartridge holder 102. In particular, the user grips the gripping unit 61 of the toner cartridge 30, and moves the toner cartridge 30 downward from a position above the cartridge holder 102 as illustrated in FIG. 17A.

With such an attachment process, the protrusion member 79 provided on the toner cartridge 30 is inserted into the guide groove 108 of the cartridge holder 102 as illustrated in FIG. 17B. During the attachment process, the protrusion member 79 moves along the guide groove 108, so that the toner cartridge 30 can be smoothly guided without force. With the attachment process, moreover, the protrusion unit 106 provided on the cartridge holder 102 is inserted into the groove 73 of the toner cartridge 30.

When the toner cartridge 30 is attached to the cartridge holder 102 as illustrated in FIG. 17C, the protrusion member 79 of the toner cartridge 30 contacts a lower end (a receiving portion) of the guide groove 108. This allows a position of an insertion direction of the toner cartridge 30 to be determined. Moreover, when the toner cartridge 30 is attached to the cartridge holder 102, the protrusion unit 106 is positioned in the narrow positioning portion 73*b* of the groove 73. This allows a position of a rotation direction of the toner cartridge 30 around the protrusion member 79 to be determined.

Moreover, as illustrated in FIG. 17C, with the attachment of the toner cartridge 30, the engaging portion 60*a* of the outer shutter 60 engages the outer shutter switch 110 protruding upward from the bottom 111 of the cartridge holder 102. The outer shutter switch 110 is integrally disposed to an upper portion of each of the process units 1Y, 1M, 1C, and 1Bk. The outer shutter switch 110 passes through an insertion hole 118 to protrude upward, the insertion hole 118 being formed on the bottom 111 of the cartridge holder 102. The engagement of the engaging portion 60*a* with the outer shutter switch 110 rotates the outer shutter 60 in a direction indicated by an arrow illustrated in FIG. 17C against tensile force (urging force) of the tension spring 72. Accordingly, the outer shutter 60 is retracted from a position opposite the discharge port 52 to open an outer opening of the discharge port 52.

With the rotation of the outer shutter 60, the torque transmission gear 64 is disposed in an operating position to mesh with the stirring drive gear 63. Moreover, when the toner cartridge 30 is attached to the cartridge holder 102, the conveyance drive gear 62 of the toner cartridge 30 meshes with the body-side drive gear 105. Accordingly, driving force of the body-side drive gear 105 can be transmitted to the conveyance screw 53 and the agitator 54 via the conveyance drive gear 62, the torque transmission gear 64, and the stirring drive gear 63.

Moreover, the toner cartridge 30 is urged toward the side wall 114 of the cartridge holder 102 by the urging member 107 (see FIG. 16) disposed on the other side wall 113 in a state that the toner cartridge 30 is attached to the cartridge holder 102. This allows a leading end of the protrusion member 79 provided in the gear cover 57 to contact a bottom of the guide groove 108, thereby restricting a movement of the toner cartridge 30 in a longitudinal direction (a vertical direction in FIG. 16). As a result, such restriction prevents the protrusion member 79 and the protrusion unit 106 from falling from the guide groove 108 and the groove 73, respectively.

When the toner cartridge 30 is detached from the cartridge holder 102, the user grips the gripping unit 61 of the toner cartridge 30 and then pulls the toner cartridge 30 upward with the cover 101 being opened.

As illustrated in FIG. 17B, when the toner cartridge 30 is pulled upward, the engaging portion 60*a* of the outer shutter 60 is disengaged from the outer shutter switch 110. Then, the outer shutter 60 is rotated by tensile force (urging force) of the tension spring 72, and returns to the original position. With the rotation of the outer shutter 60, the outer opening of the discharge port 52 is closed, and the torque transmission gear 64 is disposed in a retracted position away from the stirring drive gear 63. Herein, the protrusion unit 106 passes the operating position of the torque transmission gear 64 on the groove 73. However, by the time the protrusion unit 106 reaches the operating position, the torque transmission gear 64 is already retracted from the groove 73. Hence, the protrusion unit 106 and the torque transmission gear 64 do not interfere with each other.

In the configuration of the present exemplary embodiment, therefore, when the toner cartridge 30 is being removed, the torque transmission gear 64 is disposed in a retracted position. This releases the connection between the conveyance drive gear 62 and the stirring drive gear 63. Consequently, even if a person such as a user drives one of the conveyance screw 53 and the agitator 54 by accidentally touching the conveyance drive gear 62 or the stirring drive gear 63, driving force is not transmitted to the other. Such a configuration can reduce a load to toner, the conveyance screw 53, or the agitator 54, the load being generated when both of the conveyance screw 53 and the agitator 54 are driven. Therefore, toner deterioration can be suppressed, and damage to the conveyance screw 53 and the agitator 54 can be prevented.

In the present exemplary embodiment, moreover, even if the user drives the conveyance screw 53, the arrangement of the return ports 70*b* and 67 in the inner shutter 70 and the hood portion 65, respectively, enables the toner to return to the developer container 51 via the return ports 70*b* and 67. This can more reliably prevent deterioration in toner and damage to the conveyance screw 53 due to a situation where the conveyance screw 53 is accidentally driven.

Figure 18:
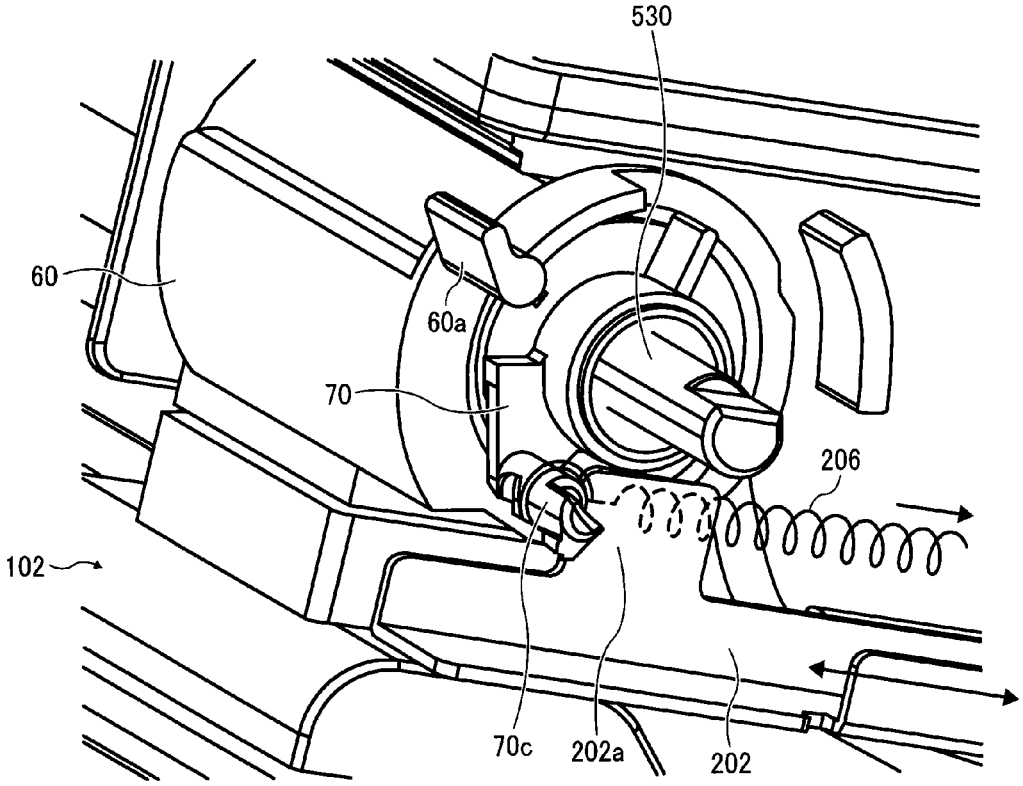
FIG. 18 is a perspective view of a structure near an inner shutter.
Figure 19A:
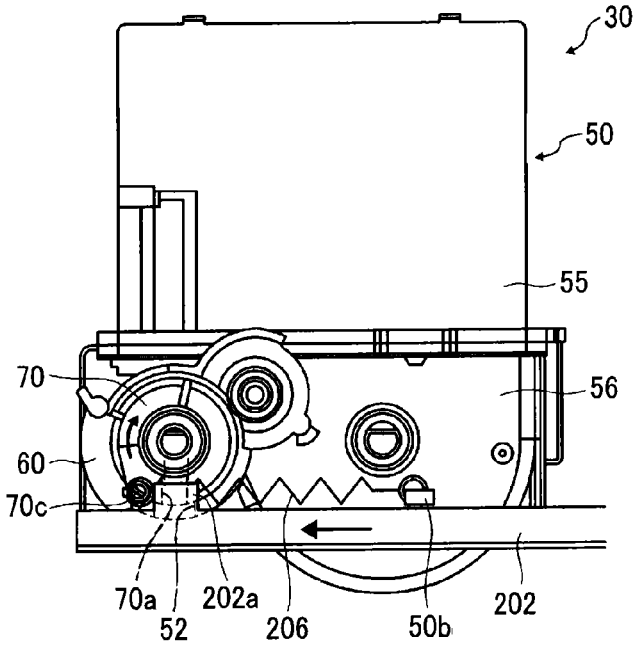
FIG. 19A is a diagram of the toner cartridge when the inner shutter is opened.
Figure 19B:
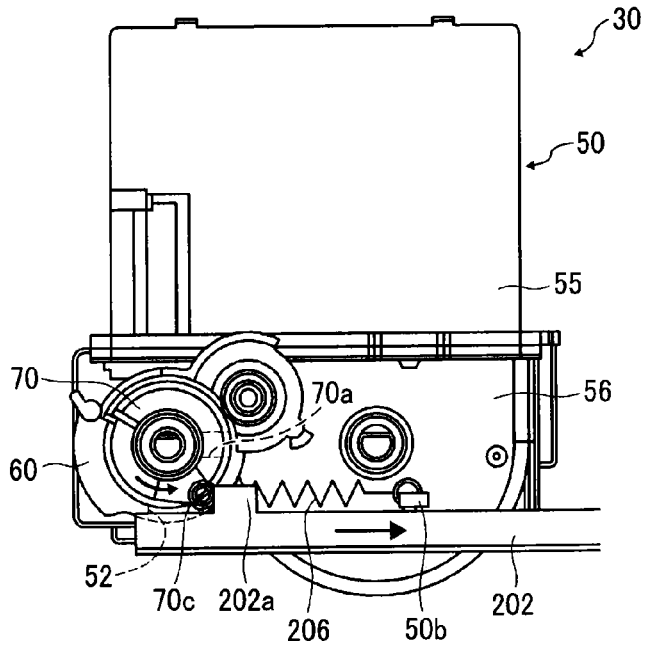
FIG. 19B is a diagram of the toner cartridge when the inner shutter is closed.

Hereinafter, a description is given of an open-close unit and a function of the inner shutter 70. FIG. 18 is a perspective view of a structure near the inner shutter 70, and FIGS. 19A and 19B are side views of FIG. 18. Each of FIGS. 18, 19A, and 19B illustrates a state in which the gear cover 57 and each of the gears such as the conveyance drive gear 62 are removed from the toner cartridge 30.

As illustrated in FIGS. 18, 19A, and 19B, the inner shutter 70 includes a projected engaging portion 70*c* that is a part of the open-close unit. The engaging portion 70*c* is disposed on an end of the inner shutter 70 exposed from the lower case 56, and protrudes in a axial direction of the inner shutter 70. A tension spring 206 is attached between the engaging portion 70*c* and a latch 50*b* provided on a side of the lower case 56. The inner shutter 70 is urged by urging force of the spring 206 toward a closing direction thereof.

The cartridge holder 102 includes an inner shutter switch 202 that is a part of the open-close unit. The inner shutter switch 202 is a long member extending in a horizontal direction. The inner shutter switch 202 is supported in a horizontally movable manner, and includes a protrusion 202*a* that protrudes upwards.

An operation for opening the inner shutter 70 is performed after an operation for opening the outer shutter 60 is completed. That is, the engaging portion 60*a* of the outer shutter 60 engages the outer shutter switch 110, and then the outer shutter 60 is rotated to open the discharge port 52. After the discharge port 52 is opened, the operation for opening the inner shutter 70 begins.

As illustrated in FIG. 19A, the inner shutter switch 202 is moved toward the left in FIG. 19A by a drive unit of the inner shutter switch 202. Such a movement of the inner shutter switch 202 opens the inner shutter 70. The inner shutter switch 202 may be automatically moved by a solenoid, or manually moved via a link unit that moves in response to the closure of the cover 101. When the inner shutter switch 202 moves, the protrusion 202*a* of the inner shutter switch 202 engages the engaging portion 70*c* of the inner shutter 70 to press the engaging portion 70*c* toward the left in FIG. 19A. Accordingly, the inner shutter 70 is rotated clockwise in FIG. 19A against the urging force of the spring 206, and the developer outlet 70*a* of the inner shutter 70 is disposed in an open position opposite the discharge port 52, thereby opening an inner opening of the discharge port 52.

On the other hand, a closing operation for the inner shutter 70 is performed before the toner cartridge 30 is removed. Unlike the opening operation as illustrated in FIG. 19A, the inner shutter switch 202 is moved toward the right in FIG. 19B by a drive unit. With the movement of the inner shutter switch 202, the inner shutter 70 is rotated counterclockwise in FIG. 19B by the urging force of the spring 206. As a result, the developer outlet 70*a* of the inner shutter 70 is disposed in a closed position not opposite the discharge port 52, thereby closing the inner opening of the discharge port 52.

According to the present exemplary embodiment, therefore, when the discharge port 52 needs to be opened, the outer shutter 60 is opened and then the inner shutter 70 is opened. When the discharge port 52 needs to be closed, the inner shutter 70 is closed and then the outer shutter 60 is closed. The outer shutter 60 and the inner shutter 70 are opened and closed in that order so that leakage of the toner from the discharge port 52 can be reliably prevented.

Figure 20A:
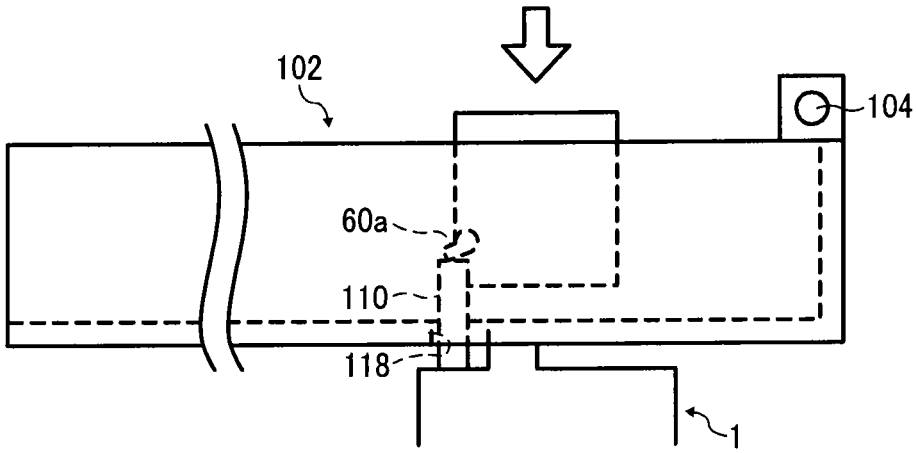
FIG. 20A is a diagram illustrating attachment of the toner cartridge to the cartridge holder.
Figure 20B:
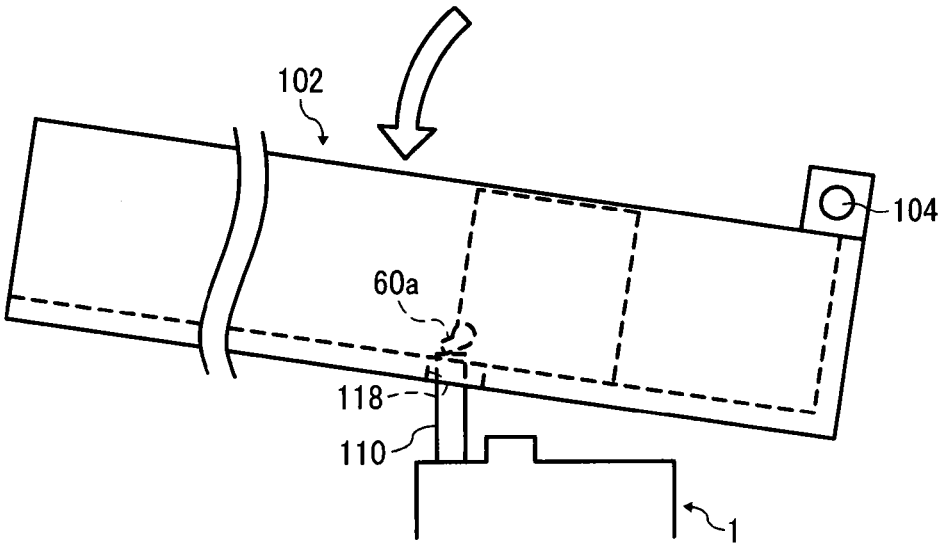
FIG. 20B is a diagram illustrating rotation of the cartridge holder.

Attachment of the toner cartridge 30 has been described with the operation for opening the outer shutter 60. In the above description, the cartridge holder 102 is disposed in the horizontal reference position, and the toner cartridge 30 is attached to the cartridge holder 102 in the horizontal reference position (see FIG. 20A). In the present exemplary embodiment, moreover, the outer shutter 60 can be opened when the cartridge holder 102 is rotated downward from the retracted position illustrated in FIG. 3. That is, when the cartridge holder 102 is rotated downward as illustrated in FIG. 20B, the outer shutter switch 110 passes through the insertion hole 118. Thus, the engaging portion 60*a* of the outer shutter 60 engages the outer shutter switch 110, so that the outer shutter 60 is rotated and opened.

The engaging portion 60*a* of the outer shutter 60 can engage the outer shutter switch 110 in any of the cases where the toner cartridge 30 is attached and the cartridge holder 102 is rotated. However, a trajectory of the outer shutter 60 approaching the outer shutter switch 110 differs in each case.

Figure 21A:
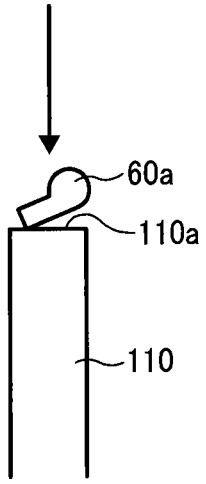
FIG. 21A is a diagram of a trajectory of an engaging portion when the toner cartridge is attached to the cartridge holder.
Figure 21B:
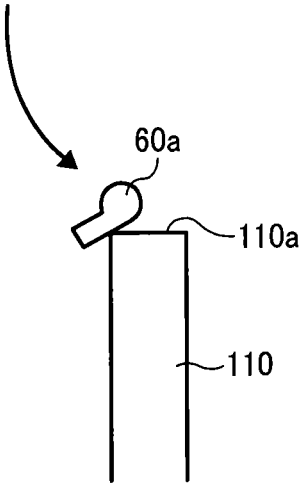
FIG. 21B is a diagram of a trajectory of the engaging portion when the cartridge holder is rotated.

Particularly, in the present exemplary embodiment, when the toner cartridge 30 is attached to the cartridge holder 102, the toner cartridge 30 is inserted downward substantially perpendicular to the cartridge holder 102. Thus, a movement trajectory of the engaging portion 60*a* is a linear trajectory in a vertical direction as illustrated in FIG. 21A. The term "linear" used herein includes not only a perfectly straight line, but also a substantially straight line. On the other hand, when the cartridge holder 102 is rotated, a movement trajectory of the engaging portion 60*a* is an arc trajectory around a rotation axis of the cartridge holder 102 as illustrated in FIG. 21B. Such a difference in the movement trajectories of the first engaging portion 60*a* causes a difficulty in reliably engaging the first engaging portion 60*a* within a predetermined area in both of the trajectories.

Moreover, in the present exemplary embodiment, the pivot 104 of the cartridge holder 102 is disposed in a position higher than an engagement location between the engaging portion 60*a* and the outer shutter switch 110 (see FIG. 20B). Consequently, in a case where the engaging portion 60*a* approaches the apparatus body 100 in the circular trajectory, a travelling direction of the engaging portion 60*a* with respect to a horizontal engagement surface (an upper end surface) 110*a* of the outer shutter switch 110 is inclined to a vertical direction. This causes the engagement to be even more difficult.

Figure 22:
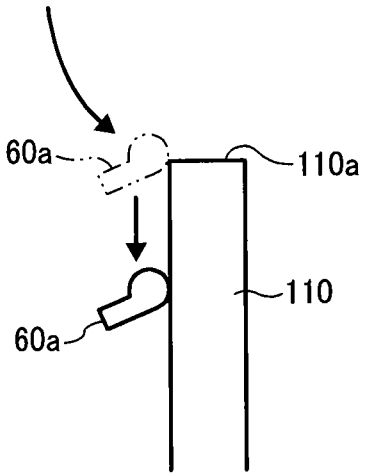
FIG. 22 is a diagram illustrating a case where the engaging portion does not engage an outer shutter switch and falls.

In addition, among the plurality of toner cartridges 30, the nearest toner cartridge 30 to the pivot 104 (a center of the circular trajectory) of the cartridge holder 102 has a small curvature radius of the circular trajectory of the engaging portion 60*a*. In such a toner cartridge 30, a travelling direction of the engaging portion 60*a* is markedly inclined to a vertical direction. As for the nearest toner cartridge 30 to the pivot 104, it is even more difficult for the engaging portion 60*a* to reliably engage the outer shutter switch 110. As a result, in a case where the engaging portion 60*a* cannot engage the engagement surface 110*a* of the outer shutter switch 110, there is a possibility that the engaging portion 60*a* may fall from the outer shutter switch 110 as illustrated in FIG. 22. In such a case, the outer shutter 60 is not opened.

Figure 23:
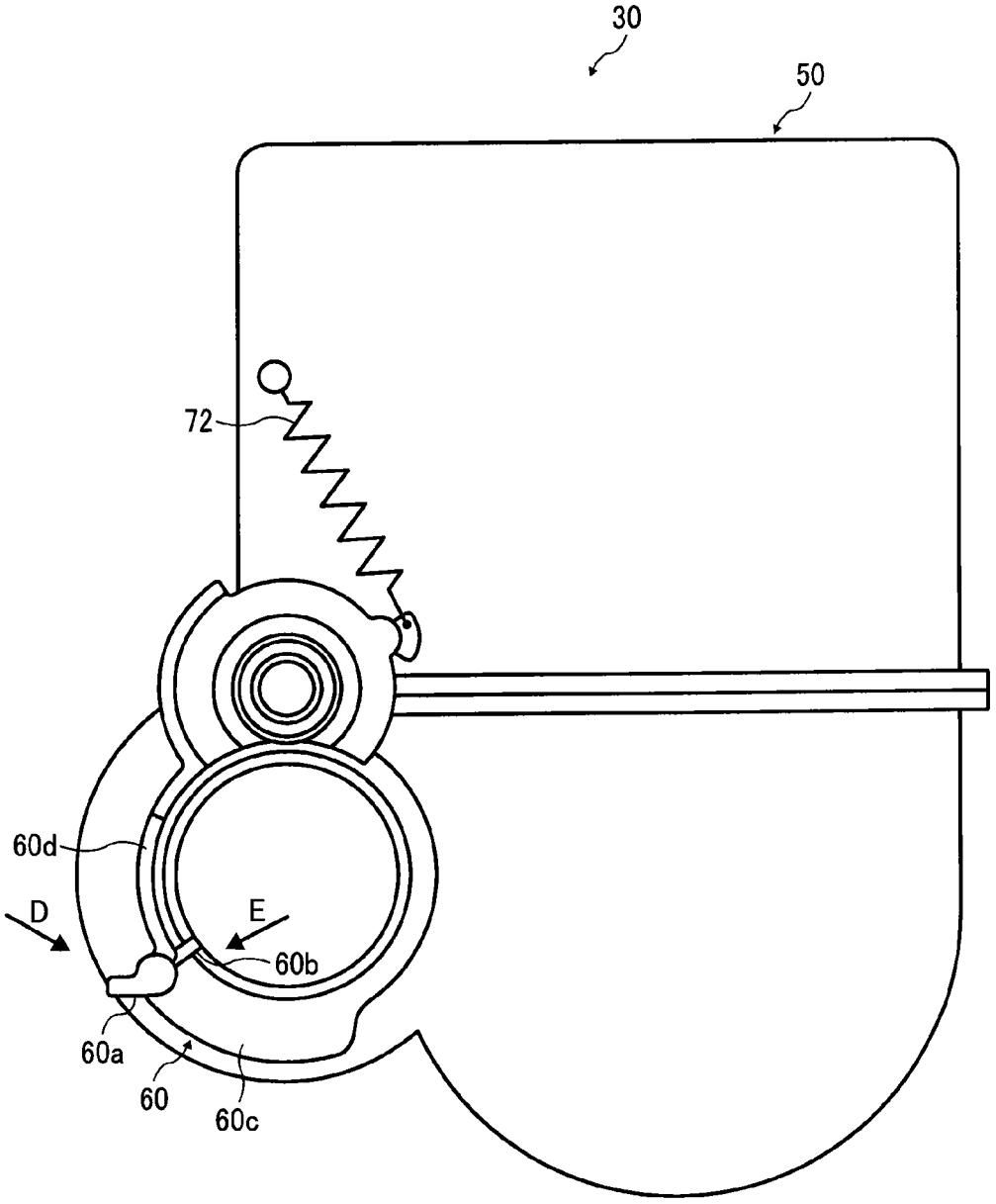
FIG. 23 is a side view of the toner cartridge with a structure of the outer shutter.
Figure 24A:
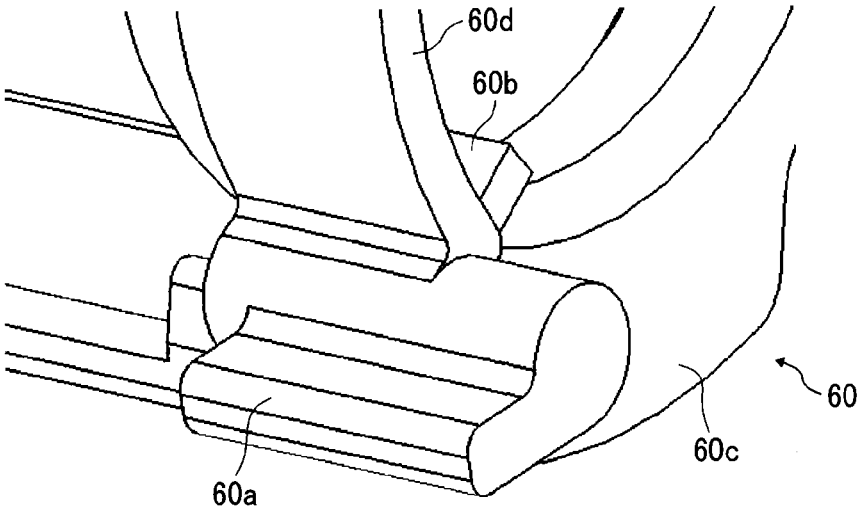
FIGS. 24A and 24B are enlarged views of the outer shutter as seen from directions respectively indicated by arrows D and E illustrated in FIG. 23.
Figure 24B:
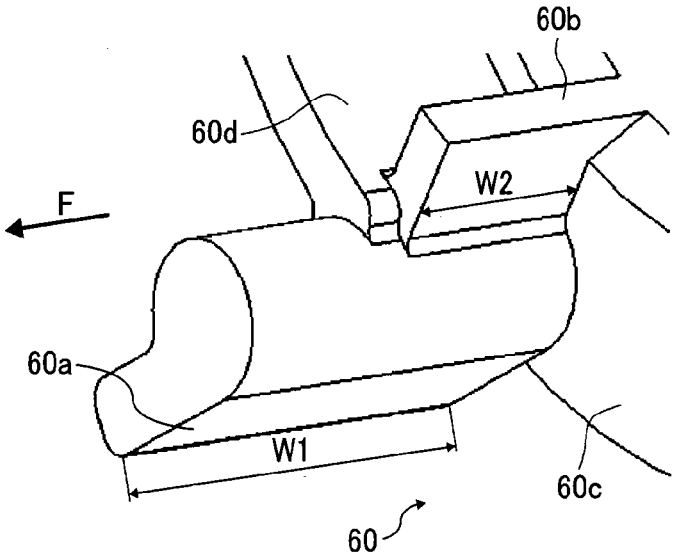

In the present exemplary embodiment, the following countermeasures are taken to deal with such a case. FIG. 23 is a side view of the cartridge 30 with a structure of the outer shutter 60. FIGS. 24A and 24B are enlarged views of the outer shutter 60 as seen from directions respectively indicated by arrows D and E illustrated in FIG. 23.

As illustrated in FIGS. 23, 24A, and 24B, the outer shutter 60 includes an engaging portion 60*b* in addition to the engaging portion 60*a* protruding in an outer radial direction from the annular supporting portion 60*d*. The engaging portion 60*b* includes a protrusion that protrudes in an inner radial direction from the supporting portion 60*d*. Hereinafter, the engaging portion 60*a* protruding in the outer radial direction is called "a first engaging portion 60*a*", and the engaging portion 60*b* protruding in the inner radial direction is called "a second engaging portion 60*b*" for the sake of convenience.

The first engaging portion 60*a* and the second engaging portion 60*b* protrude in opposite directions from the same position in a circumferential direction of the supporting portion 60*d*. As illustrated in FIG. 24B, the first engaging portion 60*a* has a width W1 in a rotation axis direction thereof, and the second engaging portion 60*b* has a width W2 in a rotation axis direction thereof. The width W1 is greater than the width W2. Moreover, the first engaging portion 60*a* protrudes outward in the rotation axis direction of the outer shutter 60 (i.e., a direction indicated by an arrow F shown in FIG. 24B) relative to the second engaging portion 60*b*.

Next, an operation for engaging the outer shutter switch 110 with the first and second engaging portions 60*a* and 60*b* is described. First, a description is given of operations performed when the toner cartridge 30 is attached to the cartridge holder 102 (a case illustrated in FIG. 20A) with reference to FIGS. 25A through 25D.

As described above, when the toner cartridge 30 is attached to the cartridge holder 102, the toner cartridge 30 is linearly guided in a vertically downward direction by the protrusion member 79 and the guide groove 108. Thus, the first engaging portion 60*a* and the second engaging portion 60*b* approach the outer shutter switch 110 in the linear trajectory as indicated by an arrow shown in FIG. 25A.

Figure 25A:
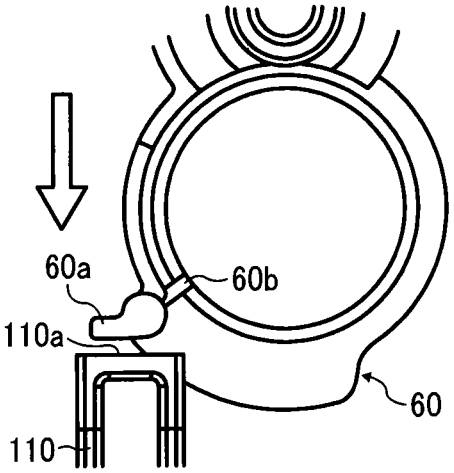
FIGS. 25A, 25B, 25C, and 25D are diagrams illustrating engagement of the first engaging portion and a second engaging portion with the outer shutter switch when the toner cartridge is attached.
Figure 25B:
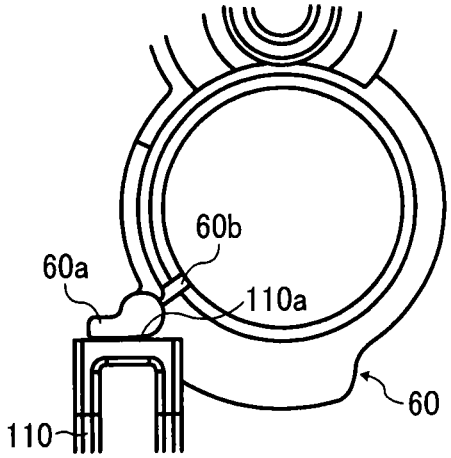
Figure 25C:
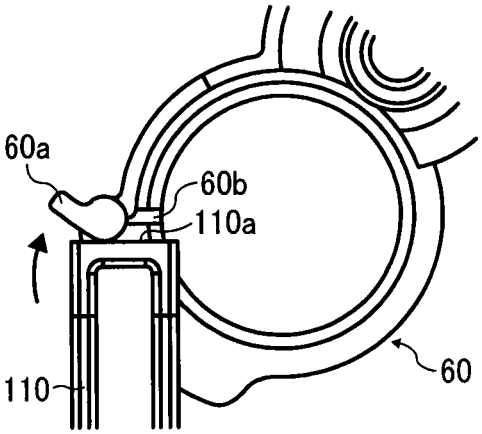
Figure 25D:
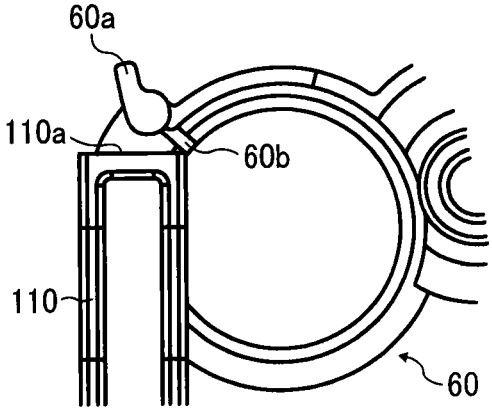

In such a case, as illustrated in FIG. 25B, the first engaging portion 60*a* first engages the engagement surface 110*a* of the outer shutter switch 110. As illustrated in FIG. 25C, when the toner cartridge 30 is further guided in the vertically downward direction, the first engaging portion 60*a* is relatively pressed by the outer shutter switch 110. This rotates the outer shutter 60 in a direction indicated by an arrow shown in FIG. 25C. Moreover, the rotation of the outer shutter 60 rotates the first engaging portion 60*a* and the second engaging portion 60*b*. Consequently, as illustrated in FIG. 25D, when the attachment of the toner cartridge 30 is completed, the first engaging portion 60*a* is separated from the engagement surface 110*a* of the outer shutter switch 110, and the second engaging portion 60*b* engages the engagement surface 110*a* instead of the first engaging portion 60*a*.

Next, FIGS. 26A through 26E illustrates operations performed when the cartridge holder 102 is rotated (a case illustrated in FIG. 20B).

When the cartridge holder 102 is rotated downward, the cartridge holder 102 moves in the arc trajectory around the pivot 104 as described above. Hence, the first engaging portion 60*a* and the second engaging portion 60*b* approach the outer shutter switch 110 in the arc circular trajectory as indicated by an arrow shown in FIG. 26A.

Figure 26A:
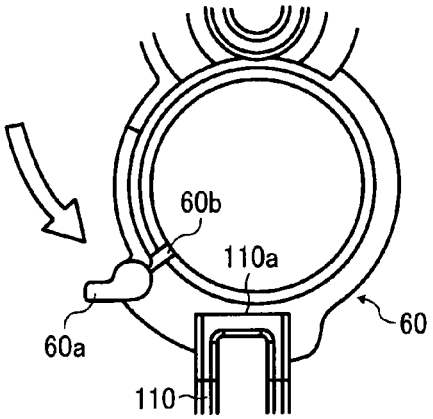
FIGS. 26A, 26B, 26C, 26D, and 26E are diagrams illustrating engagement of the first engaging portion and the second engaging portion with the outer shutter switch when the cartridge holder is rotated.
Figure 26B:
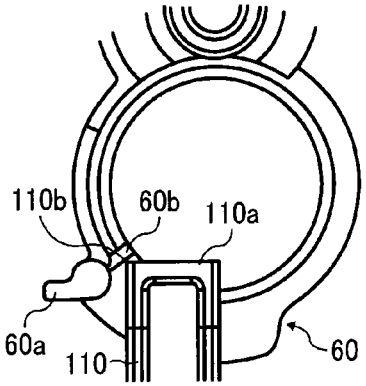
Figure 26C:
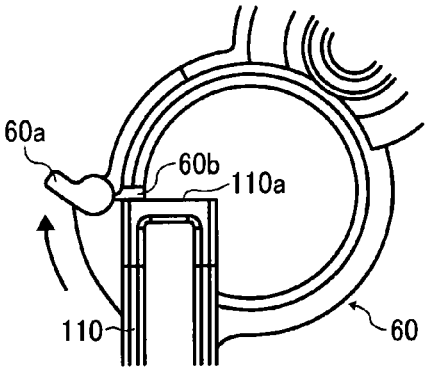

In this case, as illustrated in FIG. 26B, the second engaging portion 60*b* first engages the engagement surface 110*a* of the outer shutter switch 110. In particular, the second engaging portion 60*b* is caught on an edge 110*b* within the engagement surface 110*a* of the outer shutter switch 110. The edge 110*b* is provided on a front side in a direction in which the outer shutter 60 approaches the outer shutter switch 110. When the cartridge holder 102 is further rotated in the downward direction as illustrated in FIG. 26C, the second engaging portion 60*b* is relatively pressed by the outer shutter switch 110. This rotates the outer shutter 60 in a direction indicated by an arrow shown in FIG. 26C. Such rotation of the outer shutter 60 changes an orientation of the second engaging portion 60*b*, so that the second engaging portion 60*b* is brought on the engagement surface 110*a* of the outer shutter switch 110.

Figure 26D:
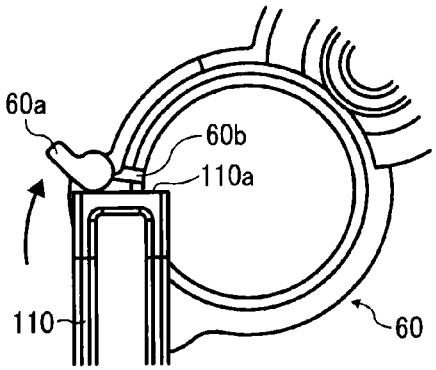
Figure 26E:
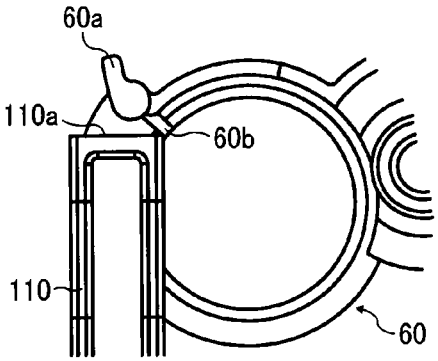

Subsequently, as illustrated in FIG. 26*d*, the first engaging portion 60*a* engages the engagement surface 110*a* of the outer shutter switch 110. Then, as illustrated in FIG. 26E, when the rotation of the cartridge holder 102 is completed, the first engaging portion 60*a* is separated from the engagement surface 110*a* of the outer shutter switch 110, whereas the second engaging portion 60*b* engages the engagement surface 110*a*.

According to the present exemplary embodiment, the engaging portion 60*a* is first engaged when the attachment of the toner cartridge 30 performed. On the other hand, the second engaging portion 60*b* is first engaged when the rotation of the cartridge holder 102 is performed. Therefore, an engaging portion to be engaged at least first varies depending on a difference in movement trajectories, so that an engagement state suitable for each of the movement trajectories can be obtained. This can prevent the engaging portion from falling from the outer shutter switch 110.

Particularly, in the present exemplary embodiment, even if there is a circular trajectory that does not tend to allow engagement with the outer shutter switch 110, the second engaging portion 60*b* can first engage the outer shutter switch 110. This can lead the first engaging portion 60*a* to engage the outer shutter switch 110. Accordingly, such a configuration can prevent the first engaging portion 60*a* from falling from the outer shutter switch 110, and enables the outer shutter 60 to be smoothly rotated and opened. Moreover, such a configuration is desirably applied to at least the toner cartridge 30 nearest to the rotation axis, that is, the toner cartridge 30 in which engagement of the first engaging portion 60*a* is difficult.

Figure 27A:
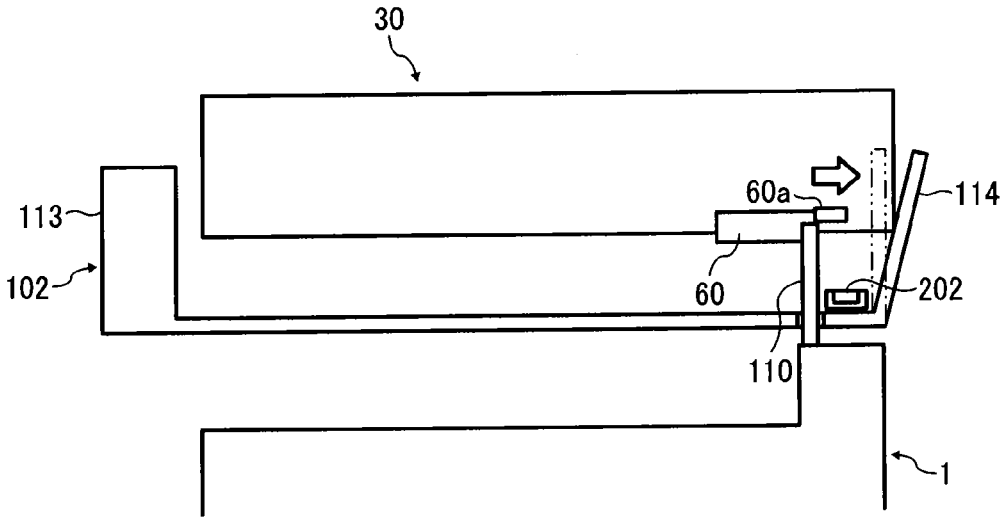
FIG. 27A is a diagram illustrating displacement of the toner cartridge caused by side wall deformation that has occurred when attachment of the toner cartridge is performed.
Figure 27B:
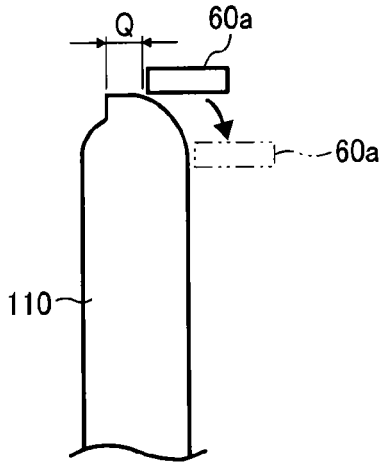
FIG. 27B is a diagram illustrating a case where the first engaging portion falls due to the displacement.

FIGS. 27A and 27B are diagrams illustrating another problem that may occur in the course of attachment of the toner cartridge 30. As illustrated in FIG. 27A, when attachment of the toner cartridge 30 is performed, the toner cartridge 30 may be pressed against the side wall 114 of the cartridge holder 102 (the outer shutter switch 110 side) in FIG. 27A. In such a case, there is a possibility that the side wall 114 may be deformed and inclined outward. In a case where the inclination due to deformation of the side wall 114 occurs, an attachment position of the toner cartridge 30 is displaced to the right in FIG. 27A. Consequently, an engagement location of the first engaging portion 60*a* with respect to the outer shutter switch 110 is also displaced to the right in FIG. 27A. Such displacement causes the first engaging portion 60*a* to go out of an engagement allowable range Q of the outer shutter switch 110, and to fall from the outer shutter switch 110 as illustrated in FIG. 27B.

Moreover, it is conceivable that such a fall of the first engaging portion 60*a* due to deformation of the side wall 114 is likely to occur if rigidity of the side wall 114 is lowered by reduction in apparatus size, or a distance between the side wall pair 113 and 114 is reduced. Moreover, if the inner shutter switch 202 is disposed near the side wall 114 as illustrated in FIG. 27A, space for the outer shutter switch 110 becomes smaller. This reduces an engagement allowable range with respect to the outer shutter switch 110, causing the first engaging portion 60*a* to be more likely to fall.

In another exemplary embodiment of the present invention, the following countermeasures are taken to deal with the above problem. Hereinafter, components and configurations that differ from those of the above exemplary embodiment will be described, and like components will be given the same reference numerals as above and description thereof will be omitted.

Figure 28A:
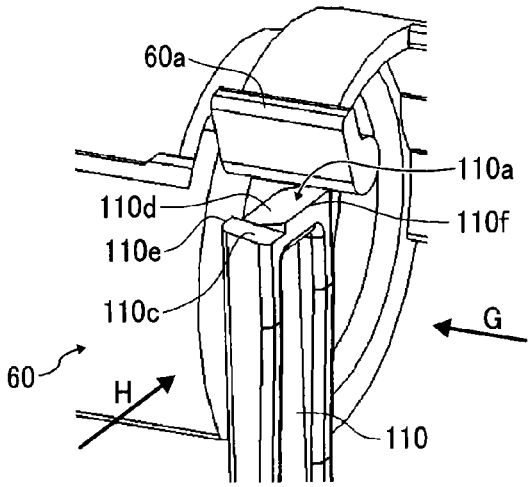
FIG. 28A is an enlarged perspective view of an outer shutter switch according to an exemplary embodiment of the present invention.
Figure 28B:
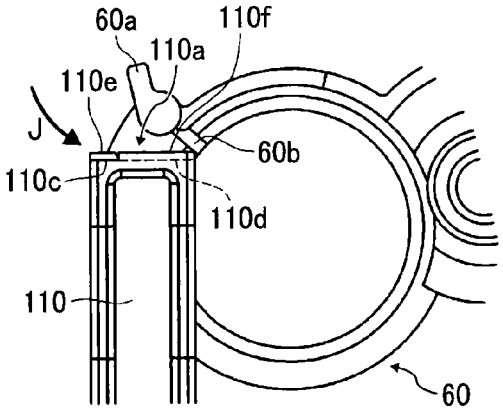
FIG. 28B is a side view of the outer shutter switch as seen from a side wall disposed opposite the outer shutter switch.
Figure 28C:
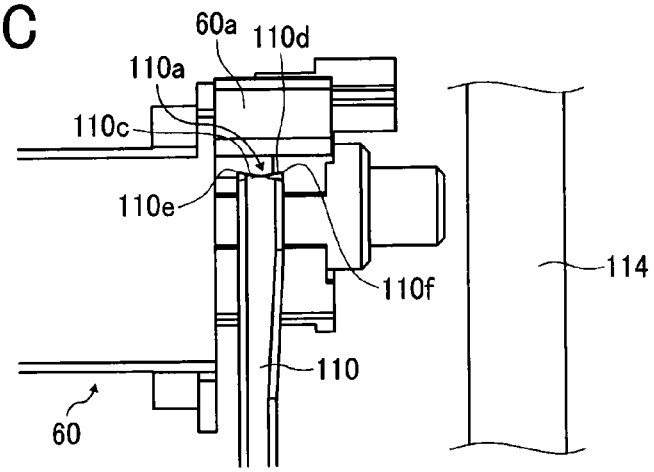
FIG. 28C is a front view of the outer shutter switch as seen from a front side in a movement direction of each engaging portion in a circular trajectory.

FIG. 28A is an enlarged perspective view of an outer shutter switch 110 according to the present exemplary embodiment of the present invention. FIG. 28B is a side view of the outer shutter switch 110 as seen from a side wall 114 side disposed opposite the outer shutter switch 110 (as seen from a direction indicated by an arrow G shown in FIG. 28A). FIG. 28C is a front view of the outer shutter switch 110 as seen from a front side in a movement direction of first and second engaging portions 60*a* and 60*b* in a circular trajectory (as seen from a direction indicated by an arrow H shown in FIG. 28A). In the following description, the side wall 114 side relative to the outer shutter switch 110 is referred to as "an apparatus outer side", and a side opposite to the apparatus outer side is referred to as "an apparatus inner side".

In the present exemplary embodiment as illustrated in FIGS. 28A through 28C, an engagement surface 110*a* of the outer shutter switch 110 includes two inclined surfaces 110*c* and 110*d* that are disposed in different orientations. Hereinafter, the inclined surfaces 110*c* and 110*d* are referred to as a first inclined surface 110*c* and a second inclined surface 110*d* for the sake of convenience. The first inclined surface 110*c* is disposed on the front side in a movement direction of the first and second engaging portions 60*a* and 60*b* in a circular trajectory, the movement direction being indicated by an arrow J shown in FIG. 28B. The second inclined surface 110*d* is disposed on the rear side in the movement direction J.

The first inclined surface 110*c* is inclined downward from the apparatus inner side toward the apparatus outer side. Unlike the first inclined surface 110*c*, the second inclined surface 110*d* is inclined downward from the apparatus outer side toward the apparatus inner side. Since the first and second inclined surfaces 110*c* and 110*d* are inclined in different directions, sharp portions 110*e* and 110*f* formed on upper ends of the respective first and second inclined surfaces 110*c* and 110*d* are provided in different positions. Each of the sharp portions 110*e* and 110*f* has a tip. That is, the sharp portion 110*e* (the tip) formed by the first inclined surface 110*c* is provided on an end of the apparatus inner side of the outer shutter 60 (i.e., the end near the side wall 114). The sharp portion 110*f* (the tip) formed by the second inclined surface 110*d* is provided on an end on the apparatus outer side of the outer shutter 60 (i.e., the end far from the side wall 114).

Next, a description is given of engagement of the first engaging portion 60*a* and the second engaging portion 60*b* with the outer shutter switch 110 according to the present exemplary embodiment. FIGS. 29A through 29D are diagrams illustrating operations performed when a toner cartridge 30 is attached (a case illustrated in FIG. 20A).

Figure 29A:
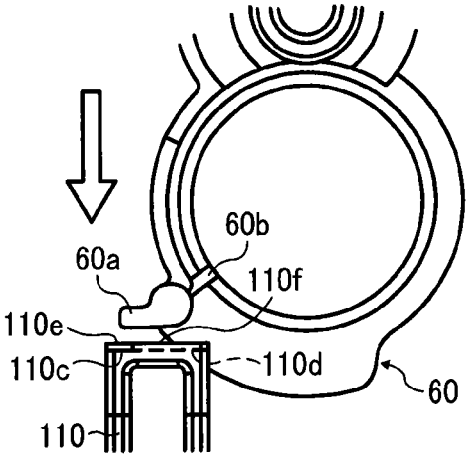
FIGS. 29A, 29B, 29C, and 29D are diagrams illustrating engagement of a first engaging portion and a second engaging portion with the outer shutter switch when a toner cartridge is attached.
Figure 29B:
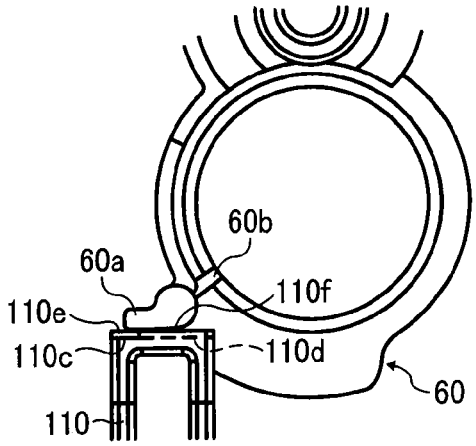

When attachment of the toner cartridge 30 is performed, the first engaging portion 60*a* and the second engaging portion 60*b* can approach the outer shutter switch 110 in a linear trajectory. In such a case, as illustrated in FIG. 29B, the first engaging portion 60*a* first engages the outer shutter switch 110 as similar to the above exemplary embodiment. Herein, the first engaging portion 60*a* engages a sharp portion 110*f* formed by a second inclined surface 110*d*.

Figure 29C:
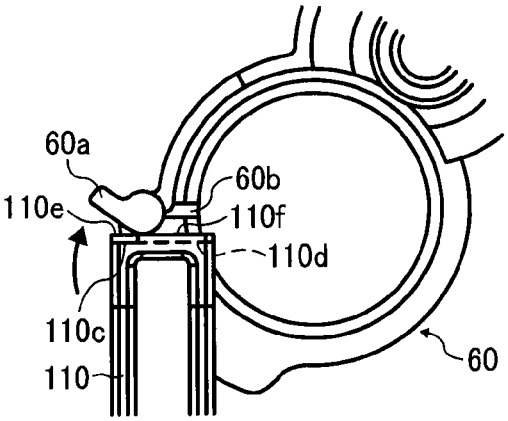
Figure 29D:
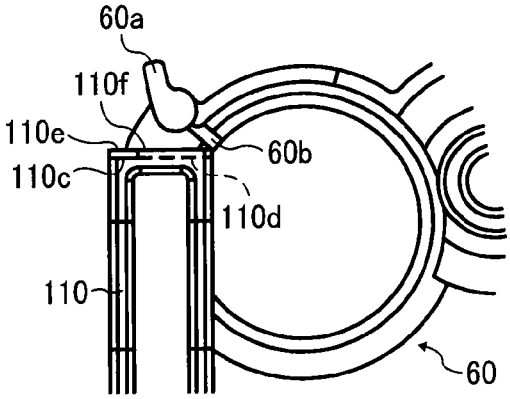

Subsequently, as illustrated in FIGS. 29B and 29C, rotation of the outer shutter 60 changes an orientation of the first engaging portion 60*a* while the first engaging portion 60*a* is engaging the sharp portion 110*f* formed by the second inclined surface 110*d*. As illustrated in FIG. 29D, when the attachment of the toner cartridge 30 is completed, the first engaging portion 60*a* is separated from the second inclined surface 110*d*, and the second engaging portion 60*b* engages the second inclined surface 110*d* instead of the first engaging portion 60*a*.

Next, FIGS. 30A through 30E illustrate operations performed when the cartridge holder 102 is rotated (a case illustrated in FIG. 20B).

Figure 30A:
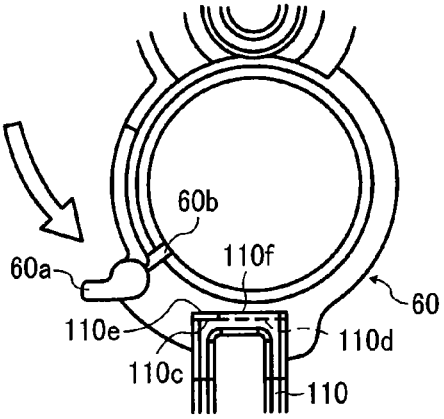
FIGS. 30A, 30B, 30C, 30D, and 30E are diagrams illustrating engagement of the first engaging portion and the second engaging portion with the outer shutter switch when a cartridge holder is rotated.
Figure 30B:
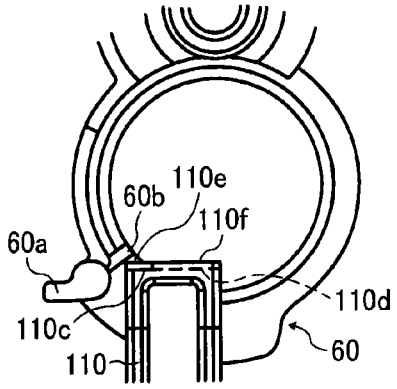

With downward rotation of the cartridge holder 102, the first engaging portion 60*a* and the second engaging portion 60*b* can approach the outer shutter switch 110 in an arch circular trajectory. In such a case, as illustrated in FIG. 30B, the second engaging portion 60*b* first engages the outer shutter switch 110 as similar to the above exemplary embodiment. Herein, the second engaging portion 60*b* engages a sharp portion 110*e* formed by the first inclined surface 110*c*.

Figure 30C:
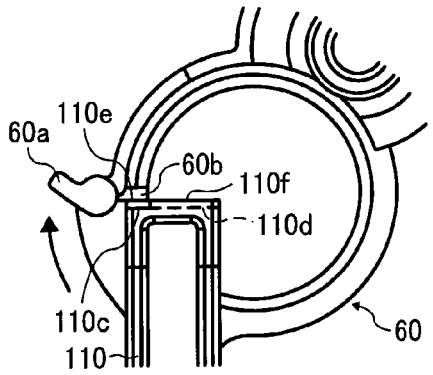
Figure 30D:
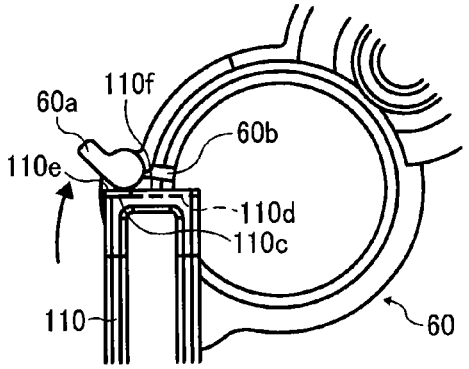

Subsequently, as illustrated in FIGS. 30B and 30C, the second engaging portion 60*b* changes an orientation thereof with rotation of the outer shutter 60 while engaging the sharp portion 110*e* formed by the first inclined surface 110*c*. Then, as illustrated in FIG. 30D, the first engaging portion 60*a* engages the sharp portion 110*e* formed by the first inclined surface 110*c*.

Figure 30E:
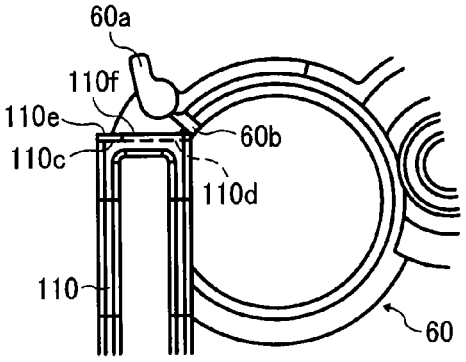

When the rotation of the cartridge holder 102 is completed as illustrated in FIG. 30E, the second engaging portion 60*b* remains in engagement with the second inclined surface 110*d*.

According to the present exemplary embodiment, therefore, when the toner cartridge 30 is attached, the first engaging portion 60*a* first engages the sharp portion 110*f* formed by the second inclined surface 110*d* (see FIG. 29B). Herein, since the first engaging portion 60*a* and the sharp portion 110*f* make contact in a line or contact in a point with each other, mutual engagement strength (grip strength) is enhanced. Therefore, the first engaging portion 60*a* can be prevented from falling from the outer shutter switch 110.

Figure 31:
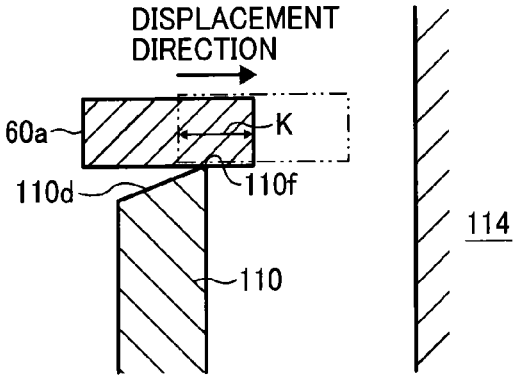
FIG. 31 is an enlarged sectional view of engagement between the first engaging portion and a second inclined surface.

Moreover, in the present exemplary embodiment, the sharp portion 110*f* (the tip) formed by the second inclined surface 110*d* is provided on an end of the apparatus outer side of the outer shutter switch 110, that is, the sharp portion 110*f* is provided on an end in a displacement direction of the outer shutter 60. This enables an engagement allowable range to be wider, thereby effectively preventing the first engaging portion 60*a* from falling. The arrangement of the sharp portion 110*f* (the tip) is set within a range K shown in FIG. 31 such that the first engaging portion 60*a* can be engaged in both cases where there is no displacement of the first engaging portion 60*a* (a state indicated by a solid line shown in FIG. 31), and there is maxim displacement of the outer shutter 60 (a state indicated by a broken line shown in FIG. 31).

Figure 32:
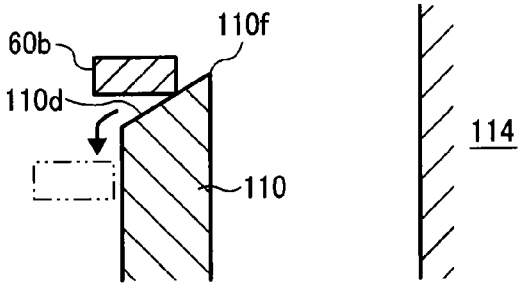
FIG. 32 is an enlarged sectional view illustrating a case where a second engaging portion slides down from the second inclined surface.

For example, an entire engagement surface 110*a* (without the first inclined surface 110*c*) of the outer shutter switch 110 may be disposed as an inclined surface that is inclined toward the same direction as the second inclined surface 110*d*. In such a case, there is a possibility that the second engaging portion 60*b*, which first engages the outer shutter switch 110 when the cartridge holder 102 is rotated, may slide down from the inclined surface. That is, in the present exemplary embodiment, since the second engaging portion 60*b* is disposed nearer to the apparatus inner side than the first engaging portion 60*a*, the second engaging portion 60*b* engages a surface (the inclined surface) as illustrated in FIG. 32, instead of a sharp portion. As a result, there is a possibility that the second engaging portion 60*b* may slide along the inclined surface to the inner side.

Figure 33:
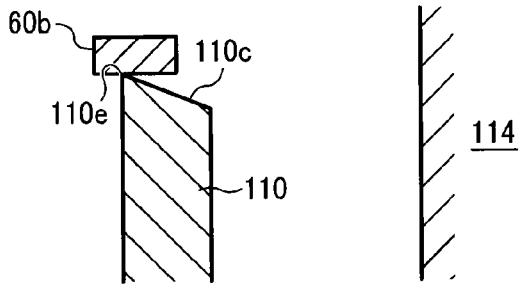
FIG. 33 is an enlarged sectional view of engagement between the second engaging portion and a first inclined surface.

According to the present exemplary embodiment, the first inclined surface 110*c* is disposed on the front side of the second inclined surface 110*d*, the first inclined surface 110*c* being inclined toward a direction opposite that of the second inclined surface 110*d*. Thus, as illustrated in FIG. 33, the second engaging portion 60*b* in a circular trajectory engages the sharp portion 110*e* provided on an end of the apparatus inner side of the first inclined surface 110*c*, thereby obtaining engagement capability by contact in a line or contact in a point. As a result, the second engaging portion 60*b* can be prevented from sliding down from the outer shutter switch 110.

Figure 34A:
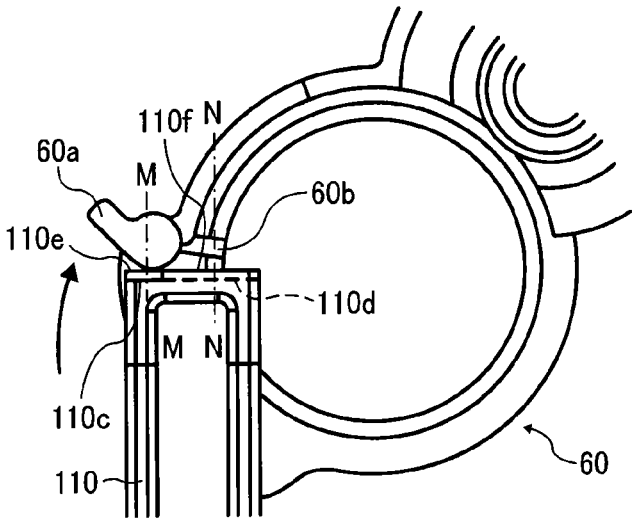
FIG. 34A is an enlarged sectional view of engagement between the engaging portions and the respective inclined surfaces.
Figure 34B:
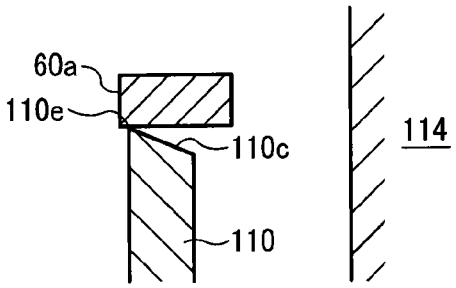
FIGS. 34B and 34C are enlarged sectional views along line M-M of FIG. 34A and line N-N of FIG. 34A, respectively.
Figure 34C:
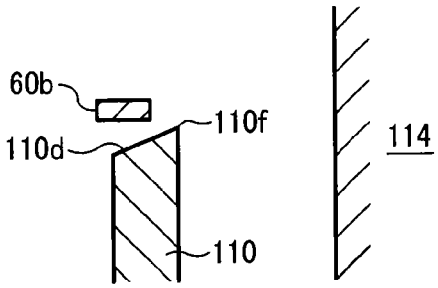

Then, the second engaging portion 60*b* moves from the first inclined surface 110*c* side to the second inclined surface 110*d* side (see FIGS. 30C and 30D). That is, as illustrated in FIG. 34C which is an enlarged sectional views along line N-N of FIG. 34A, the second engaging portion 60*b* is moved to the second inclined surface 110*d* from which the second engaging portion 60*b* may slide down. Herein, as illustrated in FIG. 34B which is an enlarged sectional views along line M-M of FIG. 34A, since the first engaging portion 60*a* is in engagement with the sharp portion 110*e*, the second engaging portion 60*b* can be prevented from sliding along the second inclined surface 110*d*.

Figure 35A:
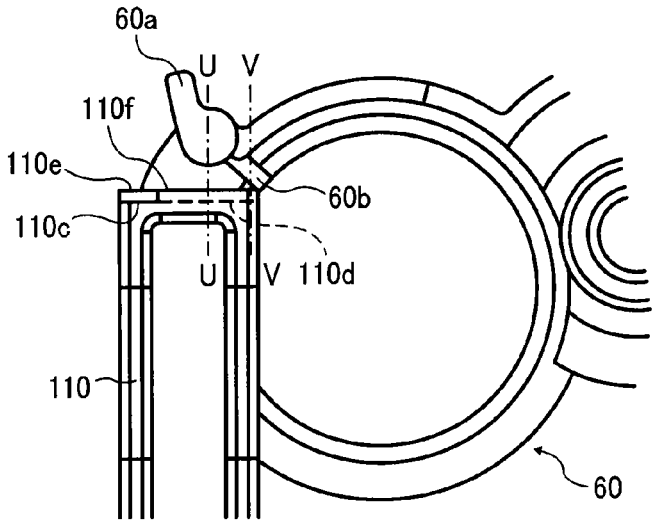
FIG. 35A is an enlarged sectional view of engagement between each of the engaging portions and the second inclined surface.
Figure 35B:
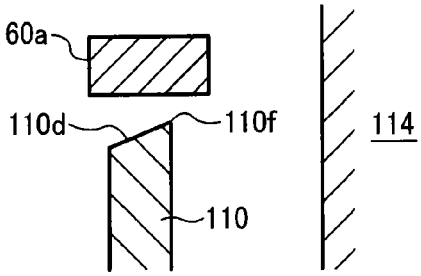
FIGS. 35B and 35C are enlarged sectional views along line U-U of FIG. 35A and line V-V of FIG. 35A, respectively.
Figure 35C:
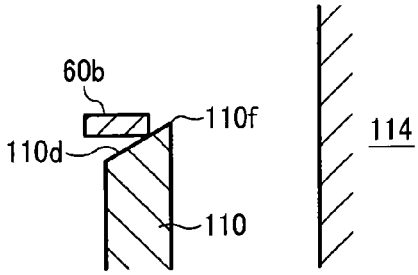

Therefore, the second engaging portion 60*b* eventually engages the second inclined surface 110*d* in any of the cases where the attachment of the toner cartridge 30 is completed, and the rotation of the cartridge holder 102 is completed (see FIG. 29D and FIG. 30E). In such a state, as illustrated in FIG. 35C which is an enlarged sectional views along line V-V of FIG. 35A, the second engaging portion 60*b* does not engage the sharp portion 110*f* formed by the second inclined surface 110*d*. However, even if the second engaging portion 60*b* slides on the second inclined surface 110*d*, the first engaging portion 60*a* engages the sharp portion 110*f* formed by the second inclined surface 110*d*. This can prevent each of the first and second engaging portions 60*a* and 60*b* from falling.

When each of the first and second engaging portions 60*a* and 60*b* engages the outer shutter switch 110, an orientation thereof may vary depending on a dimensional tolerance of a member, an attachment error of a member, or deformation of a member at the time of attachment. Accordingly, each of the sharp portions 110*e* and 110*f* desirably includes an inclined surface having an inclination angle that is greater than a change in orientation angle of each of the first and second engaging portions 60*a* and 60*b* (e.g., an inclination angle is 10 degrees or greater). Such an inclined surface is desired such that each of the sharp portions 110*e* and 110*f* can make contact in a line or contact in a point with the first and second engaging portions 60*a* and 60*b* even if an orientation of each of the first and second engaging portions 60*a* and 60*b* varies in some degree.

Figure 36A:
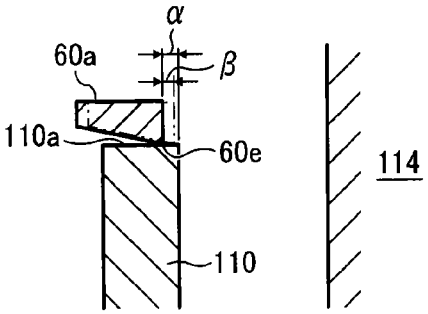
FIGS. 36A and 36B are enlarged sectional views of the engaging portions each including a sharp portion.
Figure 36B:
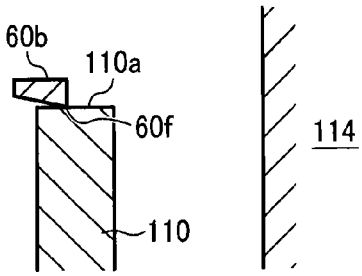

Moreover, as illustrated in FIGS. 36A and 36B, the first and second engaging portions 60*a* and 60*b* may include respective sharp portions 60*e* and 60*f*, unlike the above exemplary embodiment. Each of the sharp portions 60*e* and 60*f* makes contact in a line or contact in a point with the engagement surface 110*a* of the outer shutter switch 110. In such a case, engagement strength between each of the first and second engaging portions 60*a* and 60*b* and the outer shutter switch 110 is enhanced, thereby preventing each of the first and second engaging portions 60*a* and 60*b* from falling. Moreover, as illustrated in FIG. 36A, the outer shutter switch 110 has an engagement allowance a that is desirably greater than a maximum displacement amount β of the first engaging portion 60*a*.

Figure 37A:
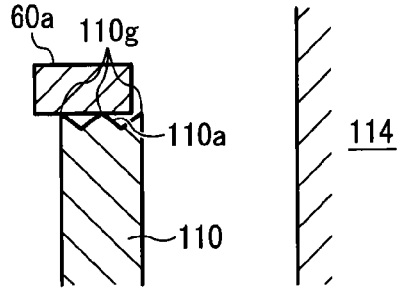
FIGS. 37A and 37B are enlarged sectional views of the outer shutter switch including a plurality of sharp portions.
Figure 37B:
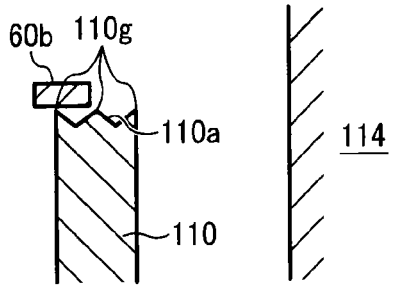

Alternatively, as illustrated in FIGS. 37A and 37B, a plurality of sharp portions 110*g* may be provided along a width direction of the outer shutter switch 110. In such a case, a range in which each of the first and second engaging portions 60*a* and 60*b* can engage the sharp portions 110*g* increases. Thus, in a case where a position of each of the first and second engaging portions 60*a* and 60*b* is displaced, the displacement is handled more easily. In addition, the plurality of sharp portions 110*g* is disposed to simultaneously engage each of the first and second engaging portions 60*a* and 60*b*, thereby enhancing the engagement strength. Hence, each of the first and second engaging portions 60*a* and 60*b* can be more reliably prevented from falling.

Figure 38A:
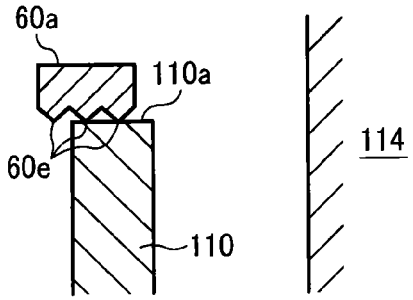
FIGS. 38A and 38B are enlarged sectional views of the engaging portions each including a plurality of sharp portions.
Figure 38B:
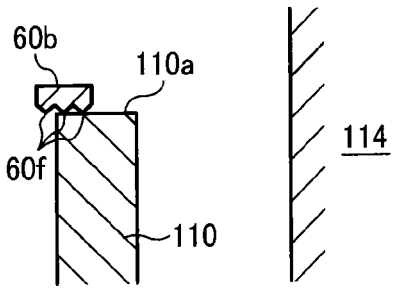

Alternatively, as illustrated in FIGS. 38A and 38B, a plurality of sharp portions 60*e* and 60*f* may be provided along a width direction of the first and second engaging portions 60*a* and 60*b*, respectively. In such a case, an advantage substantially similar to that illustrated in FIGS. 37A and 37B can be obtained.

Figure 39A:
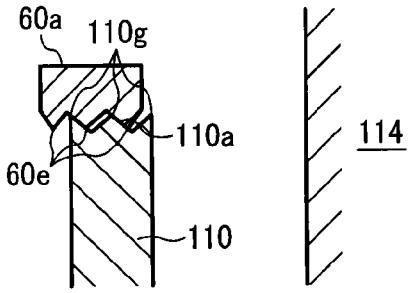
FIGS. 39A and 39B are enlarged sectional views of the inclined areas and the outer shutter switch each including a plurality of sharp portions.
Figure 39B:
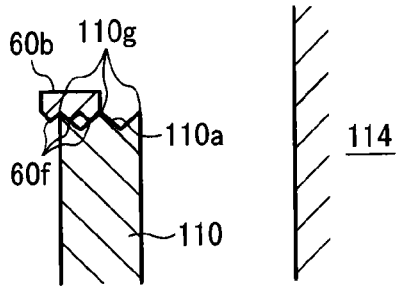

In addition, as illustrated in FIGS. 39A and 39B, the first engaging portion 60*a*, the second engaging portion 60*b*, and the outer shutter switch 110 may include a plurality of respective sharp portions 60*e*, 60*f*, and 110*g* aligned in a width direction. In such a case, each of the sharp portions 60*e* and 60*f* of the respective the first and second engaging portions 60*a* and 60*b* meshes with the sharp portion 110*g*, so that the engagement strength is enhanced even more. In FIGS. 39A and 39B, each of the first and second engaging portions 60*a* and 60*b* and the outer shutter switch 110 has a plurality of sharp portions. However, each of the first and second engaging portions 60*a* and 60*b* and the outer shutter switch 110 may have one sharp portion.

Figure 40A:
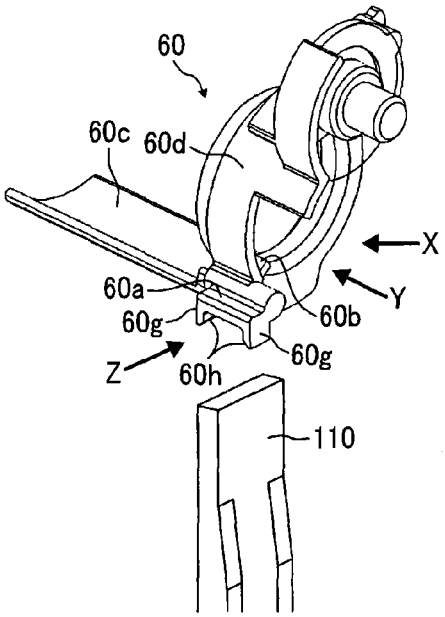
FIG. 40A is a perspective view of an outer shutter according to an exemplary embodiment of the present invention.
Figure 40B:
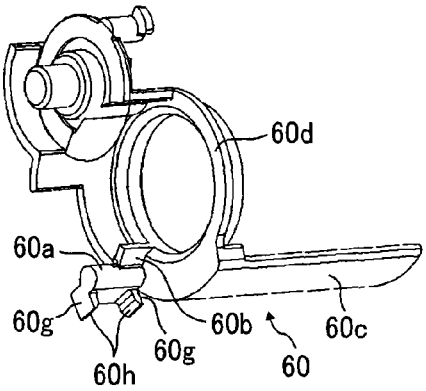
FIG. 40B is a perspective view of the outer shutter as seen from a direction indicated by an arrow X shown in FIG. 40A.
Figure 40C:
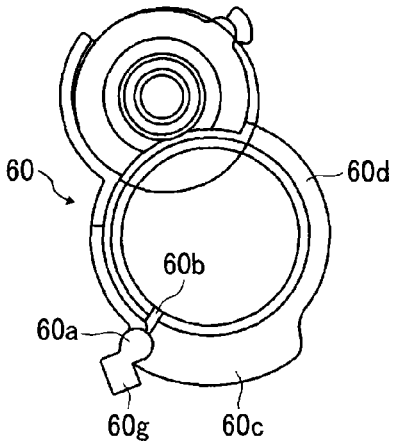
FIG. 40C is a side view of the outer shutter as seen from a direction indicated by an arrow Y shown in FIG. 40A.

FIGS. 40A through 40D illustrate another exemplary embodiment of the present invention. Components and configurations that differ from those of the above exemplary embodiments will be described, and like components will be given the same reference numerals as above and description thereof will be omitted. FIG. 40A is a perspective view of an outer shutter 60 according to the present exemplary embodiment, FIG. 40B is a perspective view of the outer shutter 60 as seen from a direction indicated by an arrow X shown in FIG. 40A. FIG. 40C is a side view of the outer shutter 60 as seen from a direction indicated by an arrow Y shown in FIG.

Figure 40D:
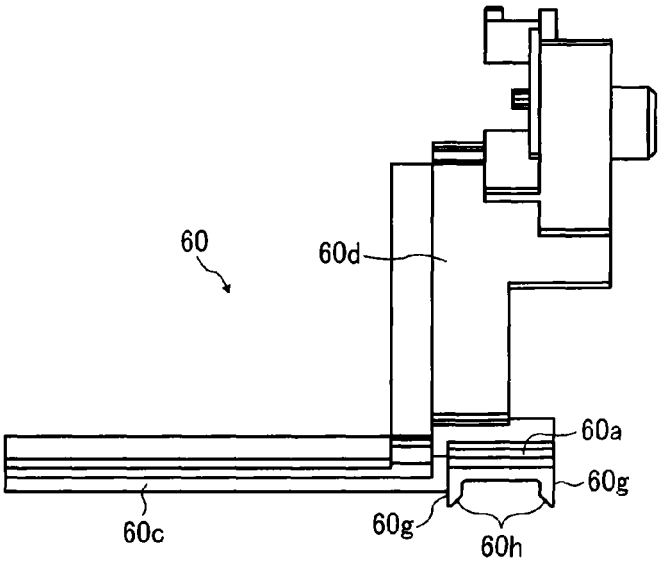
FIG. 40D is a front view of the outer shutter as seen from a direction indicated by an arrow Z shown in FIG. 40A.

40A, and FIG. 40D is a front view of the outer shutter 60 as seen from a direction indicated by an arrow Z shown in FIG. 40A.

In the present exemplary embodiment, as illustrated in FIGS. 40A through 40D, a pair of restriction portions 60*g* is provided to an outer end and an inner end of a first engaging portion 60*a*. The pair of restriction portions 60*g* protrudes toward an outer radial direction of the outer shutter 60. Moreover, the pair of restriction portions 60*g* is disposed parallel to each other, and includes inclined surfaces 60*h* formed on respective surfaces that are opposite each other. The inclined surfaces 60*h* are inclined toward directions separating from each other toward respective edges (or outer radial directions).

Figure 41:
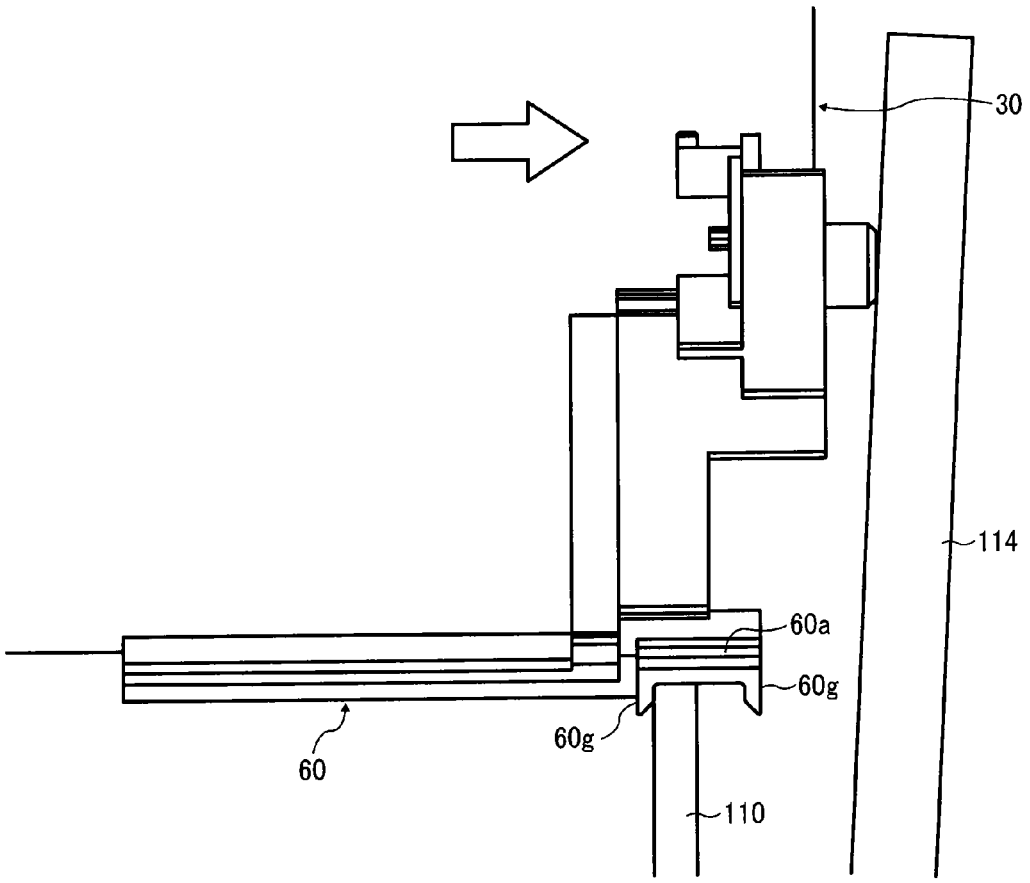
FIG. 41 is a diagram illustrating a case where a restriction unit restricts a movement of the first engaging portion in a falling direction.

According to such a configuration, even if the first engaging portion 60*a* is displaced to the right relative to an outer shutter switch 110 in attachment of a toner cartridge 30 as illustrated in FIG. 41, one of the restriction portions 60*g* (one in the left in FIG. 41) contacts the outer shutter switch 110. This restricts further displacement of the first engaging portion 60*a* relative to the outer shutter switch 110. Hence, the first engaging portion 60*a* can be prevented from falling. On the other hand, if the first engaging portion 60*a* is displaced to the left, the other restriction portion 60*g* (on the right in FIG. 41) contacts the outer shutter switch 110. This also restricts a movement of the first engaging portion 60*a* in a falling direction.

In the present exemplary embodiment, moreover, since the inclined surfaces 60*h* are provided on ends of the respective restriction portions 60*g*, the restriction portions 60*g* are unlikely to be caught on an upper edge of the outer shutter switch 110. This enables the first engaging portion 60*a* and the outer shutter switch 110 to smoothly engage each other. Alternatively, a similar restriction portion may be provided on the second engaging portion 60*b* to restrict a movement of the second engaging portion 60*b* in a falling direction.

The exemplary embodiments of the present invention have been described. However, configurations similar to the above exemplary embodiments can achieve advantages and effects similar to those described above.

Each of the above exemplary embodiments of the present invention is not limited thereto. Various changes are possible for functions, arrangements, shapes, and the number of components without departing from the spirit and scope of the invention. In each of the above exemplary embodiments, the discharge port 52 is opened and closed by the double shutter including the outer shutter 60 and the inner shutter 70. However, the exemplary embodiments of the present invention can be applied to a configuration in which the discharge port 52 is opened and closed by a single shutter (e.g., the outer shutter 60).

Moreover, in each of the above exemplary embodiments, the outer shutter switch 110 is provided in the process unit 1. However, the outer shutter switch 110 may be provided in the apparatus body 100.

Figure 42:
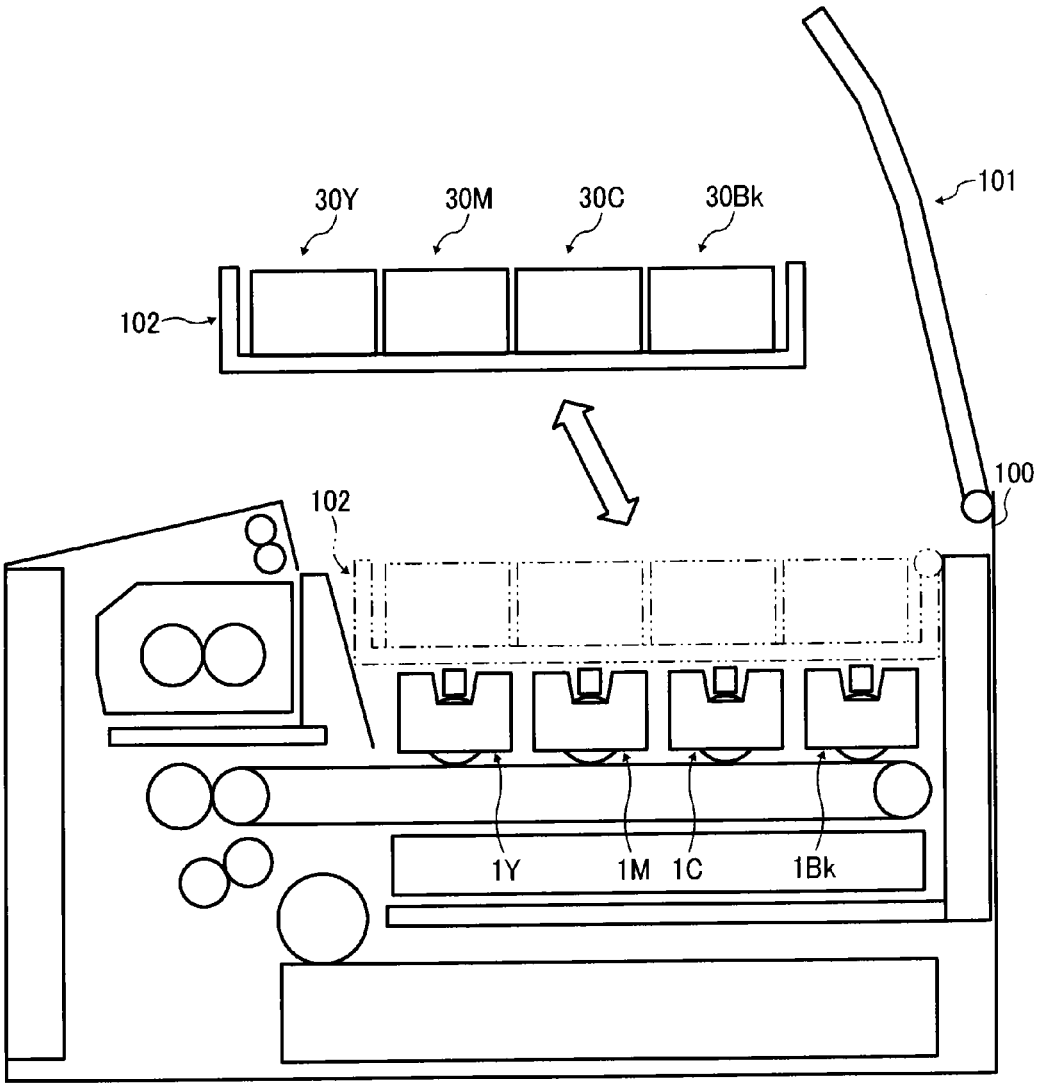
FIG. 42 is a diagram of an image forming apparatus employing a configuration in which a cartridge holder is detachable.

Moreover, as illustrated in FIG. 42, the cartridge holder 102 may be detachably attached to the apparatus body 100. In such a case, an engaging portion of the toner cartridge 30 approaches a shutter switch in a third trajectory in addition to a first trajectory and a second trajectory. The first trajectory serves as a linear trajectory used when the toner cartridge 30 is attached. The second trajectory is used when the cartridge holder 102 is rotated. The third trajectory is used when the cartridge holder 102 is attached to the apparatus body 100. When the engaging portion moves in the third trajectory, the first engaging portion 60*a* or the second engaging portion 60*b* can be disposed to first engage the shutter switch. That is, an engaging portion to at least first engage the shutter switch varies depending on whether the third trajectory or the first trajectory is used, or the third trajectory or the second trajectory is used, so that an engagement state suitable for each trajectory can be obtained.

The configuration according to each of the exemplary embodiments of the present invention may be applied to, for example, a waste toner container that includes an opening for introducing a waste toner to the inside thereof and a shutter for opening and closing the opening, in addition to the toner cartridge for storing replenishment toner.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A powder container that stores powder used for an image forming apparatus, the powder container comprising:
- a container body;
- an opening in the container body through which to discharge or introduce the powder; and
- a shutter to open and close the opening;
- the shutter including:
  - a first engaging portion to engage a shutter switch, provided to an apparatus body of the image forming apparatus, in a first trajectory; and
  - a second engaging portion to engage the shutter switch in a second trajectory different from the first trajectory,
- the shutter approaching and contacting the shutter switch in the first trajectory or the second trajectory to open and close the opening,
- wherein the second engaging portion engages the shutter switch in the second trajectory before engaging the first engaging portion, and guides the first engaging portion to engage the shutter switch.

2. The powder container according to claim 1, wherein the first engaging portion and the second engaging portion each includes a protrusion.

3. The powder container according to claim 1, wherein the first trajectory is a linear trajectory, and the second trajectory is a circular trajectory.

4. The powder container according to claim 1, wherein at least one of the first engaging portion and the second engaging portion includes a sharp portion to make contact in a line or contact in a point with the shutter switch.

5. The powder container according to claim 1, wherein at least one of the first engaging portion and the second engaging portion includes a restriction portion that contacts the shutter switch to restrict a movement of the first engaging portion or the second engaging portion with respect to the shutter switch.

6. The powder container according to claim 1, wherein the shutter is a rotational shutter that rotates to open and close the opening.

7. The powder container according to claim 6,
- wherein the first engaging portion includes a projection protruding outwardly in a radial direction of the shutter.

8. The powder container according to claim 7, wherein the second engaging portion includes a projection protruding inwardly in the radial direction of the shutter.

9. The powder container according to claim 7, wherein the container body includes toner as the powder.

10. An image forming apparatus comprising:

a powder container that stores powder used for image formation, the powder container including:

a container body;

an opening in the container body through which to discharge or introduce the powder; and a shutter to open and close the opening;

an apparatus body; and a shutter switch, provided to the apparatus body, to contact the shutter to open the shutter, the shutter including:

a first engaging portion to engage the shutter switch in a first trajectory; and a second engaging portion to engage the shutter switch in a second trajectory different from the first trajectory, the shutter approaching and contacting the shutter switch in the first trajectory or the second trajectory to open and close the opening, wherein the second engaging portion engages the shutter switch in the second trajectory before engaging the first engaging portion, and guides the first engaging portion to engage the shutter switch.

11. The image forming apparatus according to claim 10, further comprising a plurality of powder containers, wherein each of the powder containers approaches the shutter switch in a linear trajectory or in a circular trajectory around a single rotation axis, and wherein, in a powder container disposed nearest a center of the circular trajectory, an engaging portion that engages the shutter switch varies depending on the linear trajectory or the circular trajectory.

12. The image forming apparatus according to claim 11, further comprising a container holder to which the powder container is moved in a line to be attached, the container holder being rotatable between a reference position in which the powder container is positioned near the shutter switch and a retracted position in which the powder container is positioned away from the shutter switch, wherein, when the powder container is attached to the container holder with the container holder in the reference position, the first engaging portion first engages the shutter switch, and wherein, when the container holder is rotated from the retracted position to the reference position with the powder container being attached to the container holder, the second engaging portion first engages the shutter switch.

13. The image forming apparatus according to claim 12, wherein the container holder is detachably attachable to the apparatus body along a third trajectory different from the first trajectory as the linear trajectory and the second trajectory as the circular trajectory, and wherein an engaging portion to engage the shutter switch varies depending on whether the third trajectory or the first trajectory is used, or the third trajectory or the second trajectory is used.

14. The image forming apparatus according to claim 10, wherein the shutter switch includes a sharp portion to make contact in a line or contact in a point with the first engaging portion and the second engaging portion.

15. The image forming apparatus according to claim 14, wherein the sharp portions are provided on both ends of an engagement surface of the shutter switch that engages the first engaging portion, one of the ends being near the side wall of a container holder and the other end being far from the side wall.

16. The image forming apparatus according to claim 14, wherein the sharp portion is provided on an end of an engagement surface of the shutter switch that engages the first engaging portion, the end being near a side wall of a container holder.

17. The image forming apparatus according to claim 10, wherein the first engaging portion includes a projection protruding outwardly in a radial direction of the shutter.

18. The image forming apparatus according to claim 17, wherein the second engaging portion includes a projection protruding inwardly in the radial direction of the shutter.

19. The image forming apparatus according to claim 10, wherein the container body includes toner as the powder.

* * * * *